US011378290B2

(12) United States Patent
Locke et al.

(10) Patent No.: US 11,378,290 B2
(45) Date of Patent: Jul. 5, 2022

(54) WATER SOURCE HEAT PUMP DUAL FUNCTIONING CONDENSING COIL

(71) Applicant: Daikin Applied Americas Inc., Minneapolis, MN (US)

(72) Inventors: Marcos Locke, Baldwinsville, NY (US); Benny DiMarco, Clay, NY (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 20 days.

(21) Appl. No.: 16/146,001

(22) Filed: Sep. 28, 2018

(65) Prior Publication Data

US 2019/0107300 A1 Apr. 11, 2019

Related U.S. Application Data

(60) Provisional application No. 62/569,188, filed on Oct. 6, 2017.

(51) Int. Cl.
*F24F 3/153* (2006.01)
*F25B 30/02* (2006.01)
(Continued)

(52) U.S. Cl.
CPC ..... *F24F 3/153* (2013.01); *F25B 13/00* (2013.01); *F25B 30/02* (2013.01); *F25B 30/06* (2013.01); *F25B 49/02* (2013.01); *F25B 2313/004* (2013.01); *F25B 2313/009* (2013.01); *F25B 2313/02731* (2013.01); *F25B 2313/02741* (2013.01); *F25B 2600/2517* (2013.01)

(58) Field of Classification Search
CPC ..... F24F 3/153; F25B 2313/02731; F25B 2313/02741; F25B 2700/1933; F25B 13/00; F25B 30/02; F25B 30/06; F25B 49/02; F25B 2313/004; F25B 2313/009; F25B 2600/2517; G25B 30/06
USPC ..... 62/90
See application file for complete search history.

(56) References Cited

U.S. PATENT DOCUMENTS 2,515,842 A * 7/1950 Swinburne ..... F24F 3/153 62/411
2,893,218 A * 7/1959 Harnish ..... F25B 13/00 62/96
(Continued)

*Primary Examiner* — Eric S Ruppert
*Assistant Examiner* — Kirstin U Oswald
(74) *Attorney, Agent, or Firm* — Global IP Counselors, LLP

(57) ABSTRACT

A heat pump system includes a compressor, a usage side heat exchanger, a heat source side heat exchanger, an expansion mechanism, a main refrigerant flow control device switchable between cooling and heating modes, a gas reheat heat exchanger, a fan, and a secondary refrigerant flow control device switchable between first, second, and third modes. Refrigerant flows from the compressor discharge line to the main refrigerant flow control device in the first mode. Refrigerant flows from discharge line to gas reheat heat exchanger and then main refrigerant flow control device in the second mode. Refrigerant flows both from discharge line to gas reheat heat exchanger and then main refrigerant flow control device, and from discharge line to main refrigerant flow control device without flowing through the gas reheat heat exchanger in the third mode. Refrigerant may flow to the usage side and hot gas reheat heat exchanger in the heating mode.

19 Claims, 21 Drawing Sheets

(51) Int. Cl.

| | |
|---|---|
| ***F25B 30/06*** | (2006.01) |
| ***F25B 49/02*** | (2006.01) |
| ***F25B 13/00*** | (2006.01) |

(56) References Cited

U.S. PATENT DOCUMENTS

| | | | | | |
|---|---|---|---|---|---|
| 3,264,840 | A * | 8/1966 | Harnish | F24F 11/30 | 62/503 |
| 3,307,368 | A * | 3/1967 | Harnish | F25B 13/00 | 62/157 |
| 3,357,198 | A * | 12/1967 | Harnish | F24F 3/1405 | 62/503 |
| 3,421,339 | A * | 1/1969 | Volk | F25B 13/00 | 62/428 |
| RE26,593 | E * | 5/1969 | Lauer | F25B 41/20 | 62/203 |
| 3,734,810 | A * | 5/1973 | Davis | F25B 41/24 | 165/240 |
| 3,844,131 | A * | 10/1974 | Gianni | F25B 45/00 | 62/149 |
| 4,030,312 | A * | 6/1977 | Wallin | F25B 29/00 | 62/235.1 |
| 4,102,390 | A * | 7/1978 | Harnish | F25B 47/022 | 62/278 |
| 4,167,102 | A * | 9/1979 | Willitts | F25B 5/02 | 62/81 |
| 4,313,313 | A * | 2/1982 | Chrostowski | F25B 47/022 | 62/278 |
| 4,325,223 | A * | 4/1982 | Cantley | F25B 49/02 | 702/182 |
| 4,352,272 | A * | 10/1982 | Taplay | F25B 41/20 | 62/235.1 |
| 4,438,881 | A * | 3/1984 | Pendergrass | F24D 11/0221 | 62/235.1 |
| 4,535,603 | A * | 8/1985 | Willitts | F25B 49/027 | 62/196.4 |
| 4,538,418 | A * | 9/1985 | Lawrence | F25B 13/00 | 62/79 |
| 4,754,609 | A * | 7/1988 | Black | B67D 1/0864 | 62/394 |
| 5,095,715 | A * | 3/1992 | Dudley | F24D 17/02 | 62/230 |
| 5,123,263 | A * | 6/1992 | Gustafson | F25B 41/20 | 165/174 |
| 5,186,012 | A * | 2/1993 | Czachorski | C09K 5/041 | 62/149 |
| 5,201,186 | A * | 4/1993 | Hanson | F25B 49/005 | 62/126 |
| 5,613,372 | A * | 3/1997 | Beal | F24F 3/153 | 62/238.7 |
| 5,626,032 | A * | 5/1997 | Neblett | F04C 18/3448 | 62/116 |
| 5,651,258 | A * | 7/1997 | Harris | F25B 41/24 | 62/196.4 |
| 5,651,265 | A * | 7/1997 | Grenier | F25B 13/00 | 165/45 |
| 5,711,161 | A * | 1/1998 | Gustafson | F25B 41/20 | 62/509 |
| 5,713,339 | A * | 2/1998 | Kishida | F02D 41/1497 | 123/676 |
| 6,055,818 | A * | 5/2000 | Valle | F24D 19/1039 | 62/196.4 |
| 7,275,384 | B2 * | 10/2007 | Taras | F24F 3/153 | 62/159 |
| 7,287,394 | B2 | 10/2007 | Taras et al. | | |
| 7,591,145 | B1 * | 9/2009 | Wiggs | F24F 3/14 | 62/176.6 |
| 10,948,203 | B2 * | 3/2021 | Blanton | F25B 29/003 | |
| 2005/0132735 | A1 * | 6/2005 | Chen | F25B 9/008 | 62/211 |
| 2006/0196225 | A1 * | 9/2006 | Han | F25B 13/00 | 62/324.1 |
| 2008/0041072 | A1 * | 2/2008 | Seefeldt | F25B 13/00 | 62/196.2 |
| 2015/0168044 | A1 * | 6/2015 | Lim | F24F 11/30 | 62/115 |
| 2017/0159977 | A1 * | 6/2017 | Hellmann | F25B 41/20 | |
| 2017/0241690 | A1 * | 8/2017 | Groshek | F04C 28/28 | |
| 2017/0276413 | A1 * | 9/2017 | Takeichi | F25B 49/027 | |

* cited by examiner

COMPACT Vertical
Refrigerant Schematic
Hot Gas Reheat
HEATING Mode

COMPACT Vertical
Refrigerant Schematic
Hot Gas Reheat
Hot Gas ReHeat Mode

COMPACT Vertical Refrigerant Schematic
Hot Gas Reheat
Hot Gas ReHeath Mode

DOAS Refrigerant Schematic Cooling Full Cooling Mode

DOAS
Refrigerant Schematic
Dehumidification
Modulating Hot
Gas Reheat Mode

DOAS Refrigerant Schematic Dehumidification Full Hot Gas Reheat Mode

DOAS Refrigerant Schematic Heating Dual Condensing Full Heating Mode

DOAS Refrigerant Schematic Heating Dual Condensing Modulating Heating Mode

DOAS
Refrigerant
Schematic Heating
Dual Condensing
Dx Coil Only Heating Mode

WATER SOURCE HEAT PUMP DUAL FUNCTIONING CONDENSING COIL

CROSS-REFERENCE TO RELATED APPLICATIONS

This application claims the benefit of U.S. Provisional Application No. 62/569,188, filed Oct. 6, 2017. The entire disclosure of U.S. Provisional Application No. 62/569,188 is hereby incorporated herein by reference.

BACKGROUND

Field of the Invention

The present invention generally relates to a refrigerant system. More specifically, the present invention relates to a heat pump with dual functioning condensing coil.

Background Information

Refrigerant systems are utilized to control the temperature and humidity of air in various indoor environments to be conditioned.

A heat pump is a refrigerant system that is typically operable in both cooling and heating modes. While air conditioners are familiar examples of heat pumps, the term "heat pump" is more general and applies to many HVAC (heating, ventilating, and air conditioning) devices used for space heating or space cooling. When a heat pump is used for heating, it employs the same basic refrigeration-type cycle used by an air conditioner or a refrigerator, but in the opposite direction, releasing heat into the conditioned space rather than the surrounding environment. In this use, heat pumps generally draw heat from cooler external air, water or from the ground.

In a cooling mode, a heat pump operates like a typical air conditioner, i.e., a refrigerant is compressed in a compressor and delivered to a condenser (or an outdoor heat exchanger). In the condenser, heat is exchanged between a medium such as outside air, water or the like and the refrigerant. From the condenser, the refrigerant passes to an expansion device, at which the refrigerant is expanded to a lower pressure and temperature, and then to an evaporator (or an indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

Reversible heat pumps work in either direction to provide heating or cooling to the internal space as mentioned above. Reversible heat pumps employ a reversing valve to reverse the flow of refrigerant from the compressor through the condenser and evaporation coils. In heating mode, the outdoor coil is an evaporator, while the indoor coil is a condenser. The refrigerant flowing from the evaporator (outdoor coil) carries the thermal energy from outside air (or soil) indoors. Vapor temperature is augmented within the pump by compressing it. The indoor coil then transfers thermal energy (including energy from the compression) to the indoor air, which is then moved around the inside of the building by an air handler.

Alternatively, thermal energy can be transferred to water, which is then used to heat the building via radiators or underfloor heating. The heated water may also be used for domestic hot water consumption. The refrigerant is then allowed to expand, cool, and absorb heat from the outdoor temperature in the outside evaporator, and the cycle repeats. This is a standard refrigeration cycle, save that the "cold" side of the refrigerator (the evaporator coil) is positioned so it is outdoors where the environment is colder.

In addition, instead of an air source heat pump, water source heat pumps can also be provided in which the outdoor unit exchanges heat with a water source, and the indoor unit exchanges heat with air. In cooling mode the cycle is similar, but the outdoor coil is now the condenser and the indoor coil (which reaches a lower temperature) is the evaporator. This is the familiar mode in which air conditioners operate. If a water coil is used for the so-called outdoor heat exchanger, it is not necessary for the water coil to be outside.

U.S. Pat. Nos. 7,275,384 and 7,287,394 disclose prior art heat pumps with reheat circuits.

SUMMARY

This invention relates to a heat pump system that is operable in both cooling and heating modes, and which utilizes a hot gas reheat coil operable in a hot gas reheat mode.

While reheat coils have been incorporated into the air source air conditioning systems operating in the cooling mode, they have not been utilized in water source heat pump systems as disclosed herein.

Water source heat pumps with dehumidification utilize a three way valve and a supplemental hot gas reheat coil to reheat air after the air has been passed through the evaporator coil. Currently the hot gas reheat coil is only employed when the unit is in dehumidification mode. This invention allows utilization of the hot gas reheat coil in heating mode as well as dehumidification mode. This invention allows hot gas refrigerant to flow to the hot gas reheat coil first then to the Dx coil. This configuration allows utilization of the dormant refrigerant coil allowing optimization of the available surface for heat transfer to occur. As a result of the unit configuration optimum air/refrigerant flow is also realized. The overall benefit to the end user can be a significant increase in heating capacity and overall improvement in efficiency (COP). Other indirect benefits of the invention allow for improved overall system optimization in cooling mode, additional heating stage through either utilizing or not utilizing the HGRH (hot gas reheat) coil, and allowing higher source water temperature in heating mode which can improve heat to cool ratios.

This methodology can also be applied to Dedicated Outdoor Air Systems (DOAS) which utilize a modulating three way valve. A significant take away is increased in heating capacity creating a greater temperature rise minimizing or even eliminating the need for any preheat supplement during extremely cold operating periods.

Basic Modes of Operation Described Below:

Cooling Mode:

Hot gas from the discharge of the compressor flows through a three way valve then the reversing valve into the (condenser). From there liquid refrigerant passes through an expansion devise and then into a Dx coil (evaporator). Refrigerant flow is then diverted to the common suction line back to the compressor through the reversing valve.

Hot Gas Reheat Mode:

Hot gas from the discharge of the compressor flows through a three way valve and is diverted to the hot gas coil. Refrigerant then flows through a check valve and T's back into the common discharge side of the reversing valve. From there refrigerant flows through the reversing valve and into the (condenser). It then passes through an expansion devise and through the Dx coil (evaporator). Refrigerant flow is then diverted to the common suction line back to the compressor through the reversing valve.

Heating Mode:

Hot gas from the discharge of the compressor flows through a three way valve and is diverted to the hot gas reheat coil. Refrigerant then flows through a check valve and T's back into the common discharge side of the reversing valve. From there refrigerant flows into the reversing valve and is diverted to the Dx coil (condenser). It then passes through an expansion devise and into a coil (evaporator). Refrigerant flow is then diverted to the common suction line back to the compressor through the reversing valve.

One or more of the foregoing objects can basically be attained by providing an air conditioning system and/or method in accordance with any one or more of the aspects below, and/or any of the features discussed below and/or illustrated in the attached drawings.

A heat pump system in accordance with a first aspect includes a compressor, a usage side heat exchanger, a heat source side heat exchanger arranged to exchange heat between a heat transfer medium and refrigerant flowing therethrough, an expansion mechanism, a main refrigerant flow control device switchable between cooling and heating modes, a gas reheat heat exchanger connected in the refrigerant circuit, a fan disposed to direct an airflow across the usage side heat exchanger and the gas reheat heat exchanger into a target space, and a secondary refrigerant flow control device switchable between first, second and third modes. The compressor delivers compressed refrigerant to a discharge line and receiving a refrigerant from a suction line. In the cooling mode, refrigerant flows from the discharge line through part of a refrigerant circuit, to the heat source side heat exchanger, to the expansion mechanism and then to the usage side heat exchanger. In the heating mode, refrigerant flows from the discharge line through part of the refrigerant circuit to the usage side heat exchanger, to the expansion device and then to the heat source side heat exchanger. In the first mode, refrigerant flows from the discharge line to the main refrigerant flow control device, In the second mode, refrigerant flows from the discharge line to the gas reheat heat exchanger and then flows to the main refrigerant flow control device. In the third mode, refrigerant flows both from the discharge line to the gas reheat heat exchanger and then flows to the main refrigerant flow control device, and from the discharge line to the main refrigerant flow control device without flowing through the gas reheat heat exchanger. The refrigerant circuit and the main and secondary refrigerant flow control devices are arranged and configured such that refrigerant may flow to the usage side heat exchanger and the hot gas reheat heat exchanger when the main refrigerant flow control device is in the heating mode.

A heat pump in accordance with a second aspect is the heat pump of the first aspect, in which the refrigerant circuit and the main and secondary refrigerant flow control devices are arranged and configured such that refrigerant may flow to the usage side heat exchanger and the hot gas reheat heat exchanger when the main refrigerant flow control device is in the cooling mode.

A heat pump in accordance with a third aspect is the heat pump of the first or second aspects, in which the refrigerant circuit and the main and secondary refrigerant flow control devices are arranged and configured such that refrigerant may flow to the usage side heat exchanger and the hot gas reheat heat exchanger when the secondary refrigerant flow control device is in at least one of the second and third modes.

A heat pump in accordance with a fourth aspect is the heat pump of the third aspect, in which the refrigerant circuit and the main and secondary refrigerant flow control devices are arranged and configured such that refrigerant may flow to the usage side heat exchanger and the hot gas reheat heat exchanger when the secondary refrigerant flow control device is in both of the second and third modes, one of the second and third modes including series flow through the hot gas reheat heat exchanger and the usage side heat exchanger, and the other of the second and third modes including parallel flow through to the usage side heat exchanger and the hot gas reheat heat exchanger.

A heat pump in accordance with a fifth aspect is the heat pump of any of the first to fourth aspects, in which the heat transfer medium of the heat source side heat exchanger is a liquid.

A heat pump in accordance with a sixth aspect is the heat pump of the fifth aspect, in which the heat transfer medium of the heat source side heat exchanger is water.

A heat pump in accordance with a seventh aspect is the heat pump of the fifth or sixth aspects, in which the heat source side heat exchanger is a brazed plate heat exchanger.

A heat pump in accordance with an eighth aspect is the heat pump of any of the first to seventh aspects, in which the secondary refrigerant flow control device is a modulating three way valve.

A heat pump in accordance with a ninth aspect is the heat pump of any of the first to eighth aspects, in which the compressor includes at least one of two stages and two compressors.

A heat pump in accordance with a tenth aspect is the heat pump of the ninth aspect, in which the compressor includes at least two compressors with each compressor including at least two stages.

A heat pump in accordance with an eleventh aspect is the heat pump of the tenth aspect, in which the compressor is an uneven tandem compressor that is operable to provide at least 8 different output stage levels.

A heat pump in accordance with a twelfth aspect is the heat pump of any of the ninth to eleventh aspects, in which the compressor output is controlled based on saturated suction temperature on a suction side of the compressor.

A heat pump in accordance with a thirteenth aspect is the heat pump of the twelfth aspect, in which the refrigerant circuit includes at least one of a suction pressure sensor and a suction temperature sensor utilized to determine the saturated suction temperature.

A heat pump in accordance with a fourteenth aspect is the heat pump of the thirteenth aspect, in which the refrigerant circuit includes a suction pressure sensor and a suction temperature sensor disposed on the suction side of the compressor, which are utilized to determine the saturated suction temperature.

A heat pump in accordance with a fifteenth aspect is the heat pump of any of the first to fourteenth aspects, in which the refrigerant circuit includes a receiver disposed on an inlet side of the expansion mechanism when the main refrigerant flow control device is in the cooling mode.

A heat pump in accordance with a sixteenth aspect is the heat pump of the fifteenth aspect, in which the refrigerant flows to the receiver when the main refrigerant flow control device is in the cooling mode, and the refrigerant does not flow to the receiver when the main refrigerant flow control device is in the heating mode.

A heat pump in accordance with a seventeenth aspect is the heat pump of the fifteenth or sixteenth aspect, in which the receiver is an inclined tube receiver, promotes phase separation, and ensures liquid seat is maintained at the EEV.

A heat pump in accordance with an eighteenth aspect is the heat pump of any of the first to seventeenth aspects, in which the main refrigerant flow control device is a four-way valve.

A heat pump in accordance with a nineteenth aspect is the heat pump of any of the first to eighteenth aspects, in which in the heating mode the heat pump is configured to heat 0 degree air to 65 degrees or more.

A heat pump in accordance with a twentieth aspect is the heat pump of the nineteenth aspect, in which the heat pump is configured to heat 0 degree air to 65 degrees or more when the main refrigerant flow control device is in a heating mode and the secondary refrigerant flow control device is in the second position, which can be considered 100% hot gas.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENT(S)

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
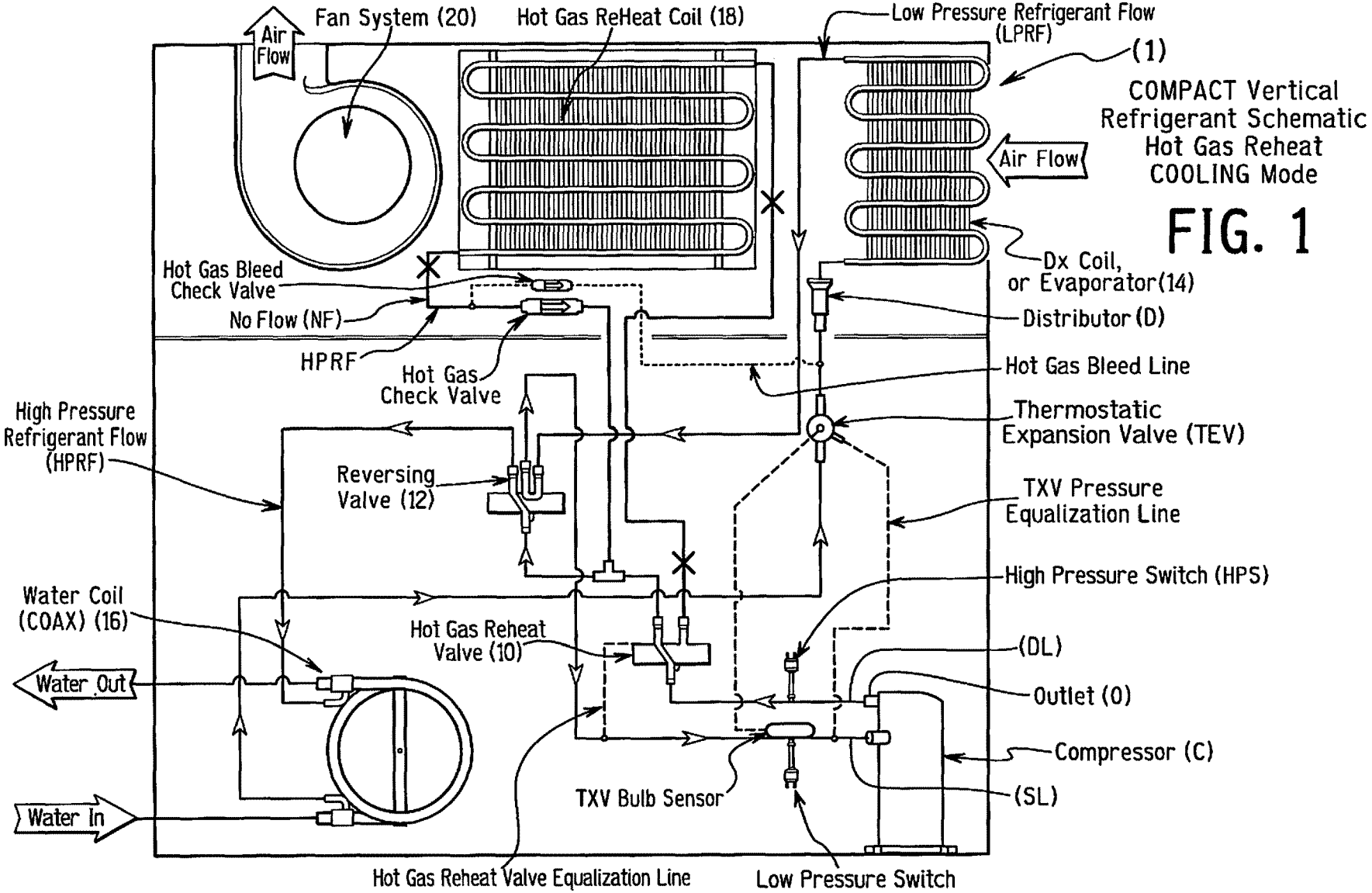
FIG. 1 illustrates a conventional water source refrigerant heat pump schematic, in a cooling mode.
Figure 2:
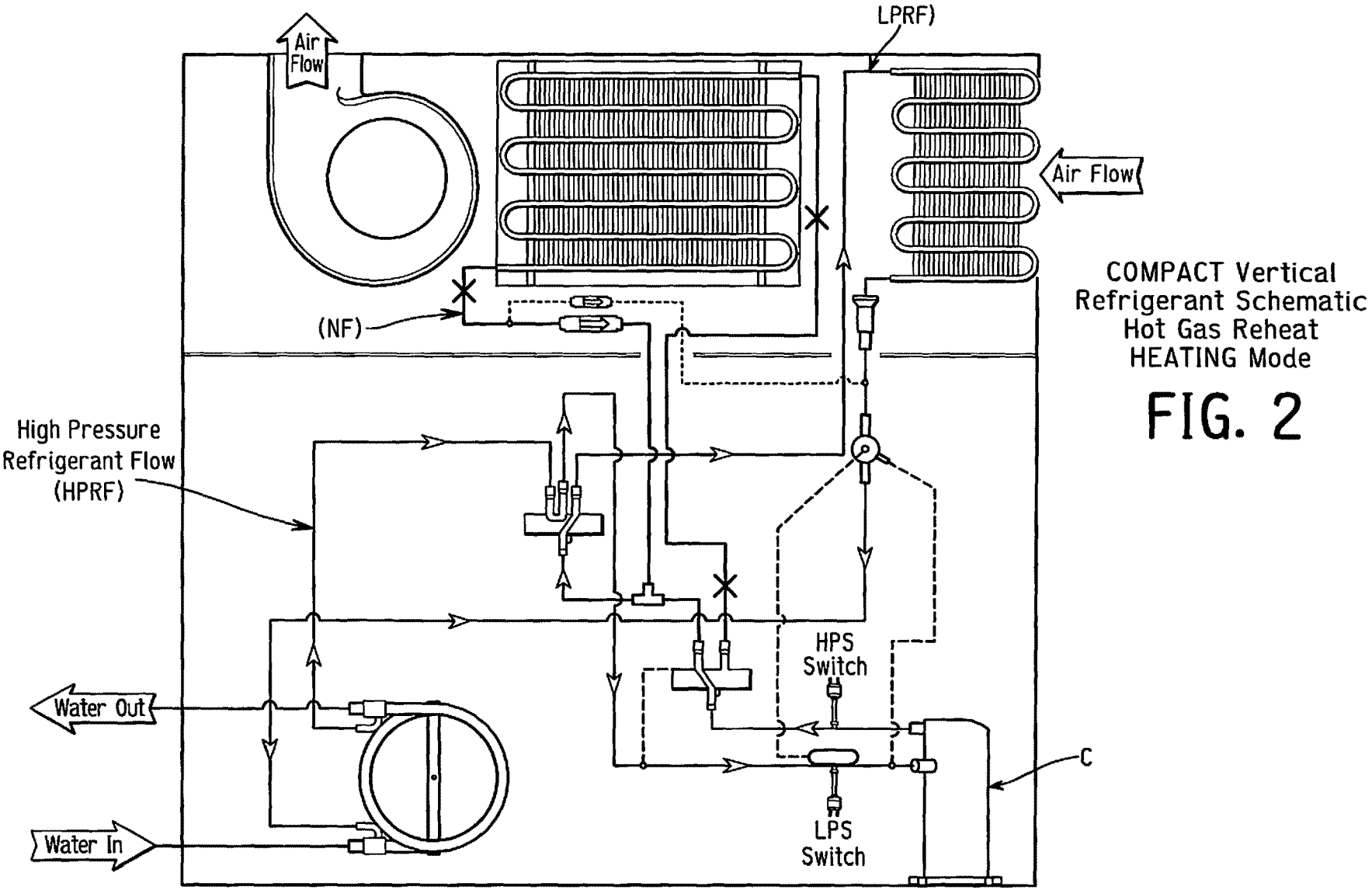
FIG. 2 illustrates the heat pump schematic of FIG. 1, in a heating mode.
Figure 3:
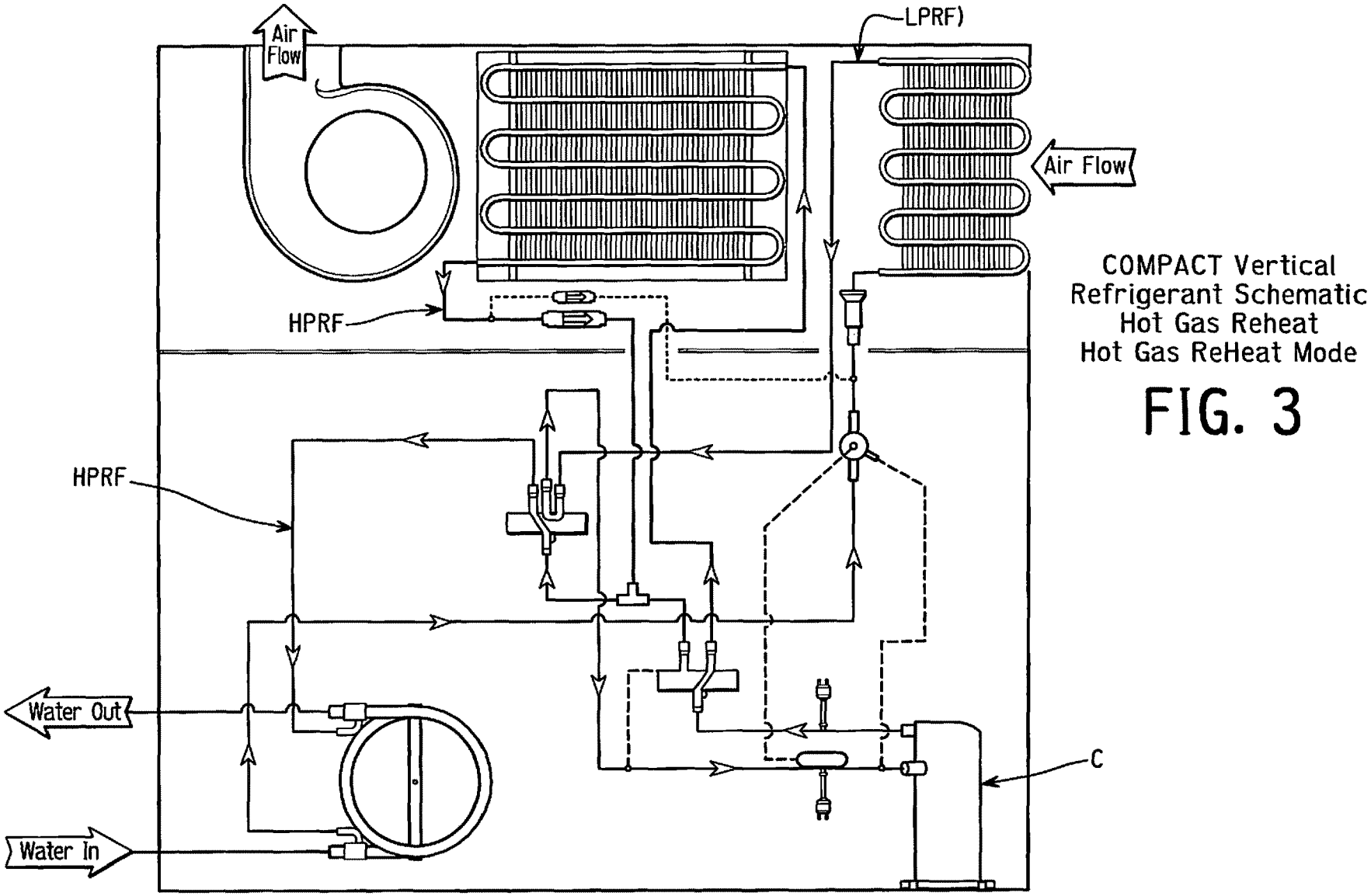
FIG. 3 illustrates the heat pump schematic of FIGS. 1-2, but in a hot gas reheat mode.
Figure 4:
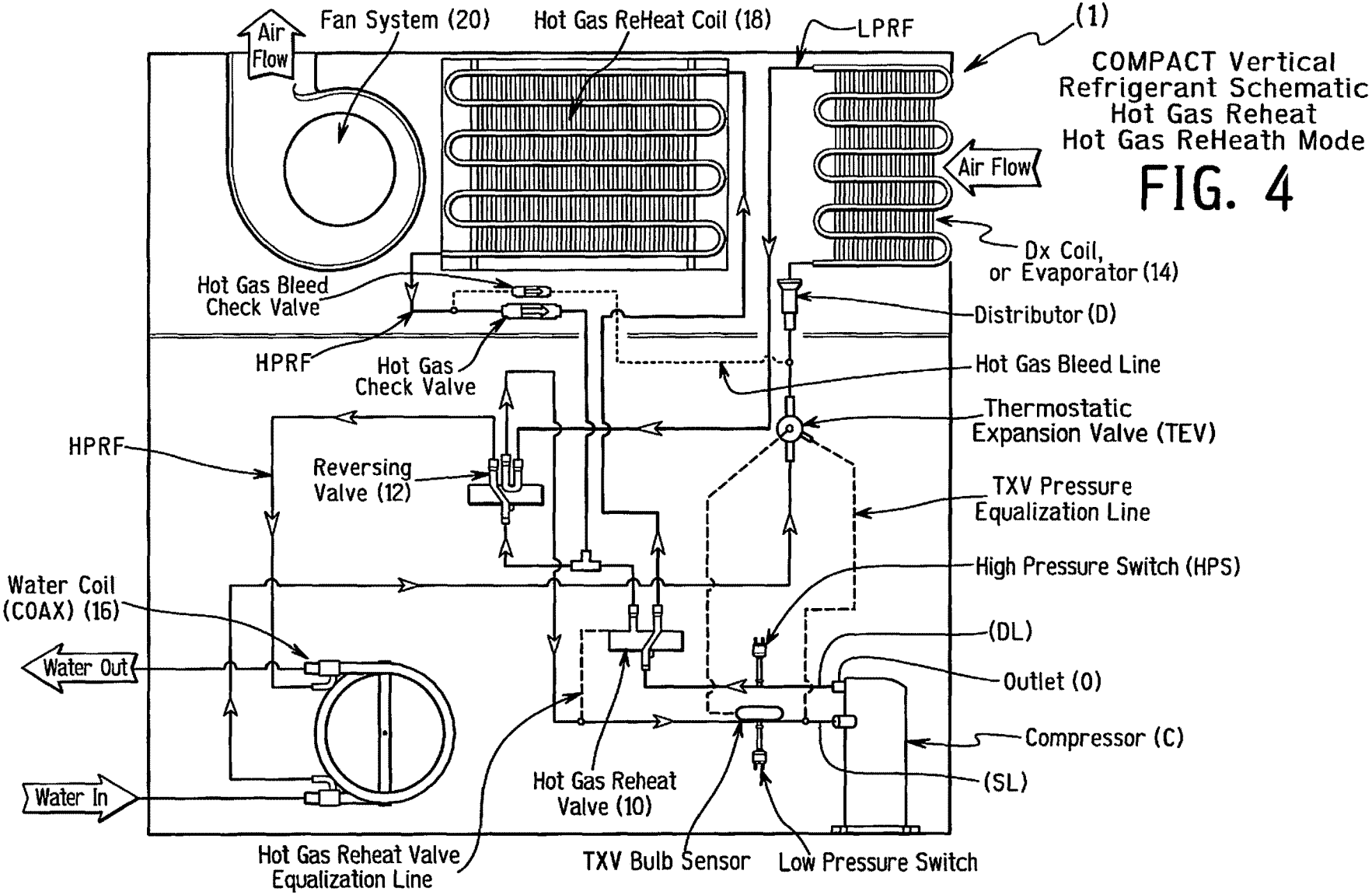
FIG. 4 illustrates the heat pump schematic of FIG. 3, in a hot gas reheat mode and with system parts identified for convenience.

Referring initially to FIGS. 1-4, a conventional water source heat pump (1) is illustrated. FIG. 1 shows the cooling mode, FIG. 2 shows the heating mode and FIG. 3 shows the hot gas reheat mode. FIG. 4 also shows the hot gas reheat mode just like FIG. 3 but further includes labels for the parts of system. These parts are the same in FIGS. 1-4, and thus, may not be included in all the Figures for the sake of convenience.

In the cooling mode of FIG. 1, compressed high pressure refrigerant flow (HPRF) exits the compressor and flows through the hot gas reheat valve (10) to the reversing valve (12), through the water coil (16) to the thermostatic expansion valve (TEV). The TEV then reduces the pressure of the refrigerant. The resulting low pressure refrigerant flow (LPRF) then flows through a distributor (D) and then through the DX coil or the Evaporator (14), back through the reversing valve (12) and back to the suction side of the compressor (C). Note the refrigerant does not flow through the hot gas reheat coil (18) (note the "x" on the flow path at several locations).

In the heating mode of FIG. 2, compressed high pressure refrigerant flow (HPRF) exits the compressor and flows through the hot gas reheat valve (10) to the reversing valve (12), through the DX coil or the Evaporator (14), and through the distributor (D) to the thermostatic expansion valve (TEV). The TEV then reduces the pressure of the refrigerant. The resulting low pressure refrigerant flow (LPRF) then flows through the water coil (16), back through the reversing valve (12) and back to the suction side of the compressor (C). Note the refrigerant does not flow through the hot gas reheat coil (18) (note the "x" on the flow path at several locations).

In the hot gas reheat mode shown in FIGS. 3-4, compressed high pressure refrigerant flow (HPRF) exits the compressor and flows through the hot gas reheat valve (10) (the flow at the hot gas reheat valve (10) is switched as compared to the cooling and heating modes) to the hot gas reheat coil (18), through the hot gas reheat coil (18), through the hot gas check valve, through the reversing valve (12), and through the water coil (16) to the TEV. The TEV then reduces the pressure of the refrigerant. The resulting low pressure refrigerant flow (LPRF) then flows through the distributor (D), the DX coil or evaporator (14), back through the reversing valve (12) and back to the suction side of the compressor (C).

In FIGS. 1-4, the gas reheat valve (10) is a conventional three-way valve that sends refrigerant out of only one of the outlets as shown in the Figures.

Referring now to FIGS. 5-10, an example of a heat pump (1') in accordance with the present invention will not be explained. The piping layout and the manner/order in which components are connected and operated result in a heat pump (1) in accordance with the present invention, even if certain parts themselves are conventional. In the heat pump (1') illustrated in these FIGS. 5-10 parts that are the same as those in FIGS. 1-4 will not be discussed. However, parts that are different from those in FIGS. 1-4 will be discussed.

First a modified compressor (C') is included. The compressor (C') includes two compressors A and B, with one of A and B being smaller than the other of A and B. In addition, each compressor A and B includes two stages. All of the stages can have different capacities. Therefore, even though the compressor (C') does not require a relatively complicated inverter control, the compressor (C') has multiple output levels, preferably at least 8. The compressor (C') is available from Emmerson or Copeland, and by itself is conventional. Because the compressor (C') is conventional, the compressor (C') will not be discussed in great detail herein except how the compressor (C') is connected and operated in the heat pump system (1') of FIGS. 5-10.

Second, a modulating 3 way valve (10') (hot gas reheat valve) is disposed at an outlet (O) of the compressor (C'). The modulating 3 way valve (10') (hot gas reheat valve) has a single inlet from the compressor (C'). However, the modulating 3 way valve (10') (hot gas reheat valve) has two outlets, one leading to a hot gas T valve and another leading to the hot gas reheat coil (18). The modulating 3 way valve (10') (hot gas reheat valve) by itself is conventional, and thus, will not be discussed in great detail herein except how the modulating 3 way valve (10') (hot gas reheat valve) is connected and operated in the heat pump system (1') of FIGS. 5-10. A conventional high pressure switch and a conventional pressure transducer are disposed between the compressor outlet (O) and the modulating 3 way valve (10') (hot gas reheat valve). The modulating 3 way valve (10') (hot gas reheat valve) can be controlled by a PID controller available from the manufacturer of the modulating 3 way valve (10') (hot gas reheat valve) in a conventional manner. In this embodiment, the modulating 3 way valve (10') (hot gas reheat valve) can be set in a first mode or position (FIGS. 5 and 10), a second position or mode (FIGS. 7 and 8) and a third position or mode (FIGS. 6 and 9) with feedback from a supply air sensor to control discharge air temperature by modulating refrigerant to the hot gas reheat coil (18).

Third, in this embodiment, an electronic expansion valve EEV is provided instead of a TEV in FIGS. 1-4. The EEV is conventional and can be controlled in a conventional manner. In addition, the EEV can be controlled in conjunction with control of the compressor (C') and the modulating 3 way valve (10') (hot gas reheat valve).

Fourth, the water coil in this embodiment is a brazed plate heat exchanger (16') (BPHE) unlike the coax water coil (16) in FIGS. 1-4. The brazed plate heat exchanger (BPHE) by itself is conventional, and thus, will not be discussed in great detail herein except how the brazed plate heat exchanger (BPHE) is connected and operated in the heat pump system (1') of FIGS. 5-10.

Figure 8:
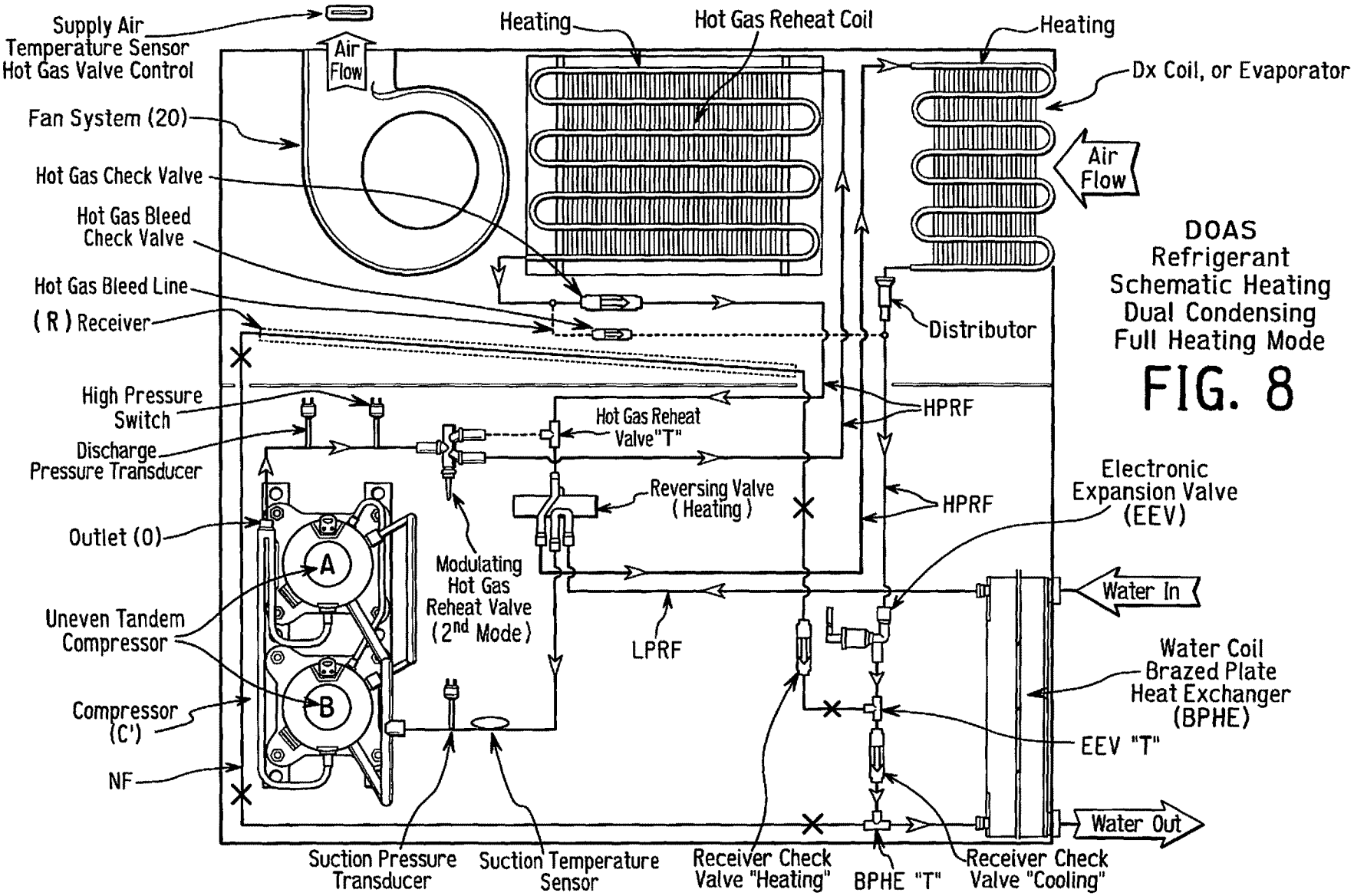
FIG. 8 is a schematic view of the heat pump illustrated in FIGS. 5-7, in a dual condensing full heating mode.
Figure 9:
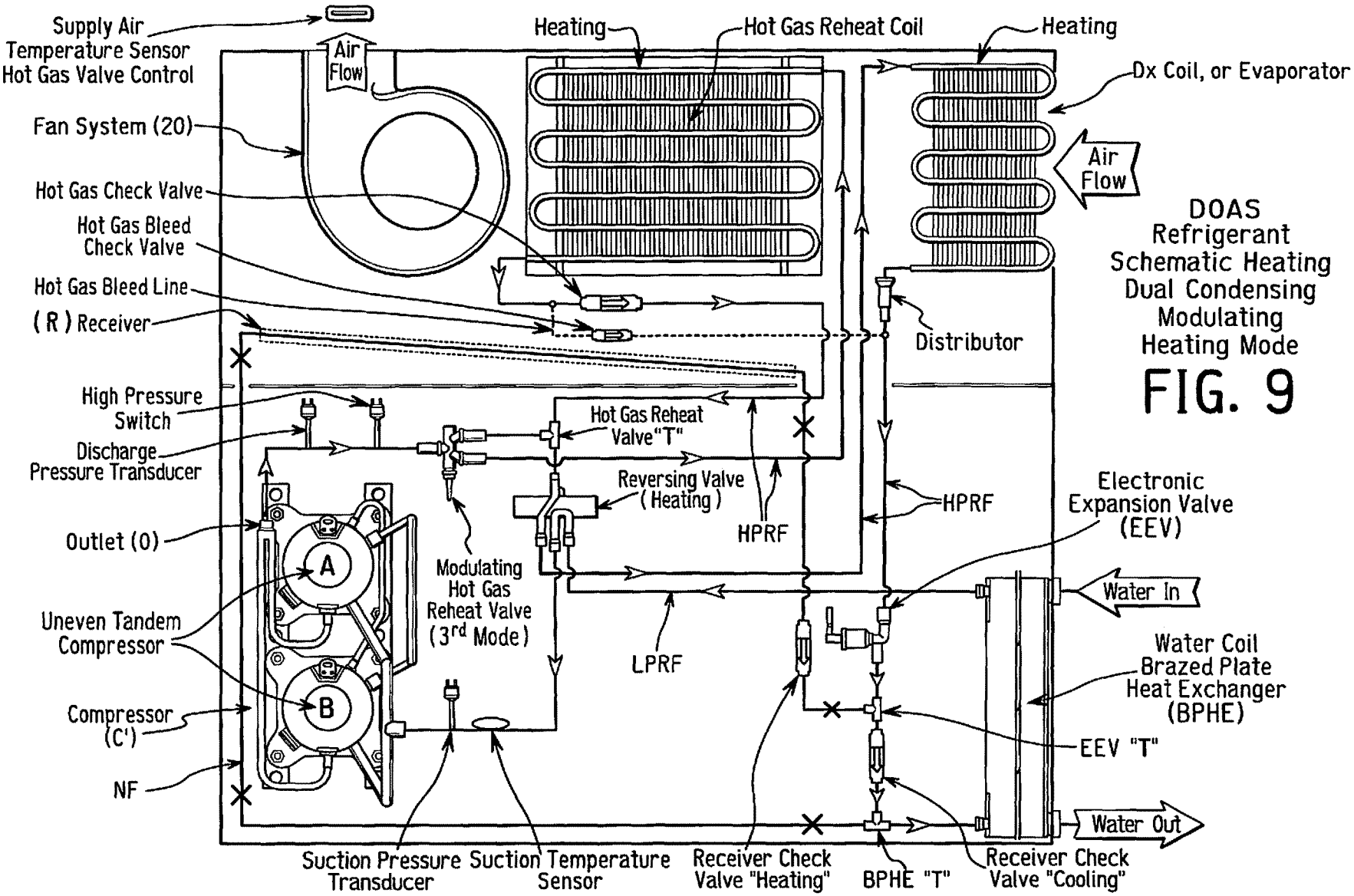
FIG. 9 is a schematic view of the heat pump illustrated in FIGS. 5-8, in a dual condensing modulating heating mode.
Figure 10:
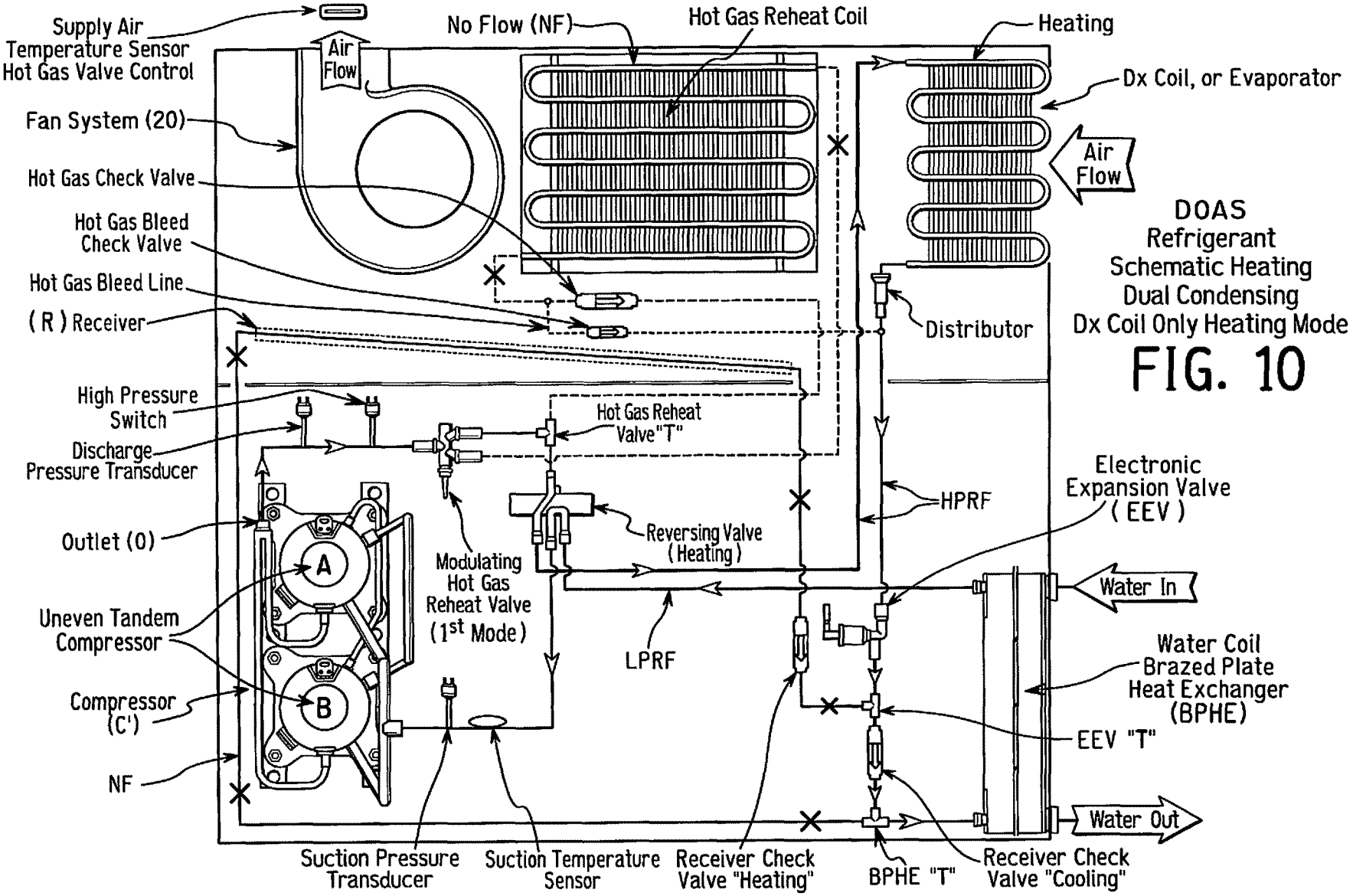
FIG. 10 is a schematic view of the heat pump illustrated in FIGS. 5-9, in a dual condensing Dx coil only heating mode.
Figure 11:
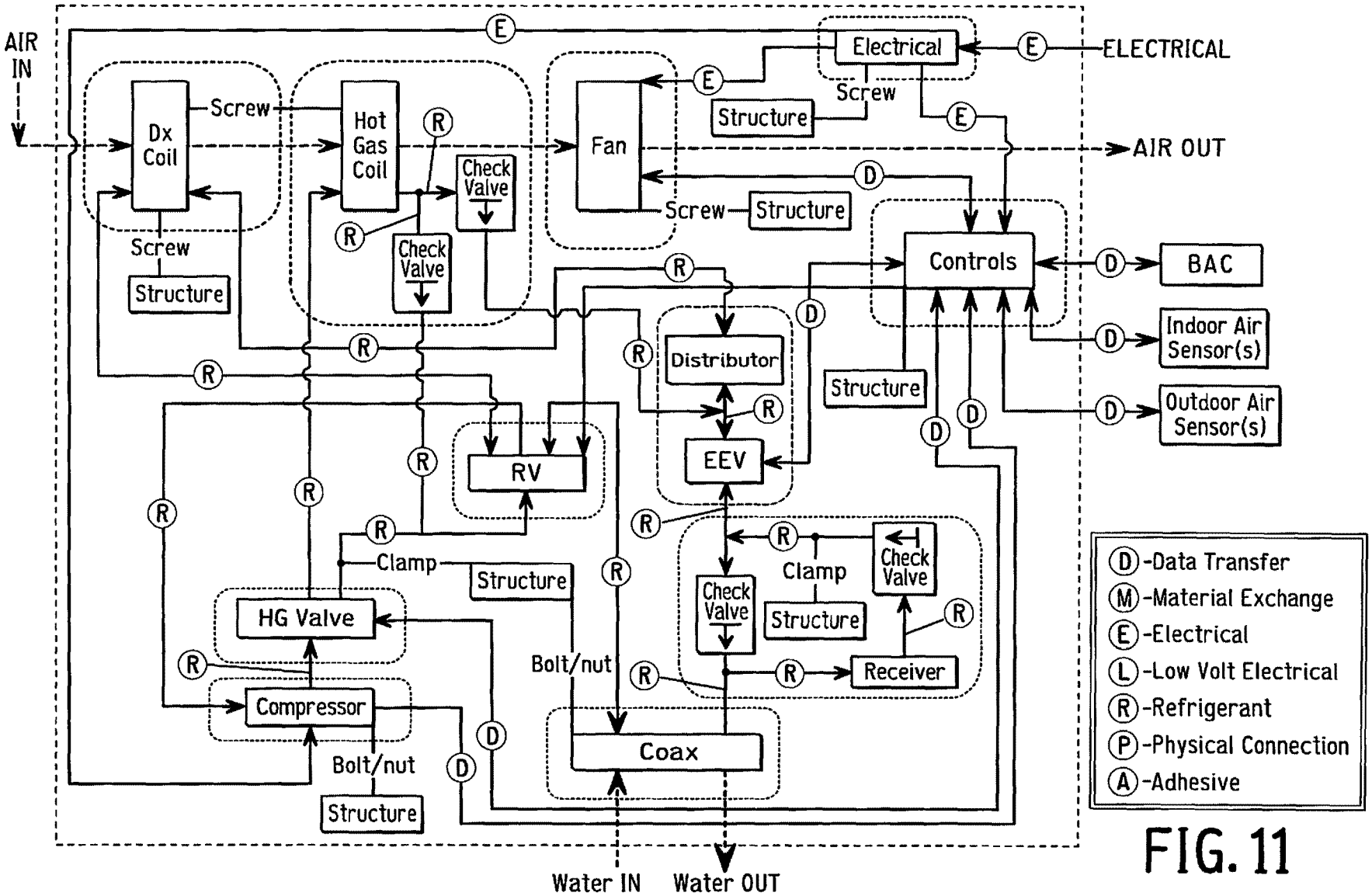
FIGS. 11-21 are schematic illustrations of the heat pump shown in FIGS. 5-10.
Figure 12:
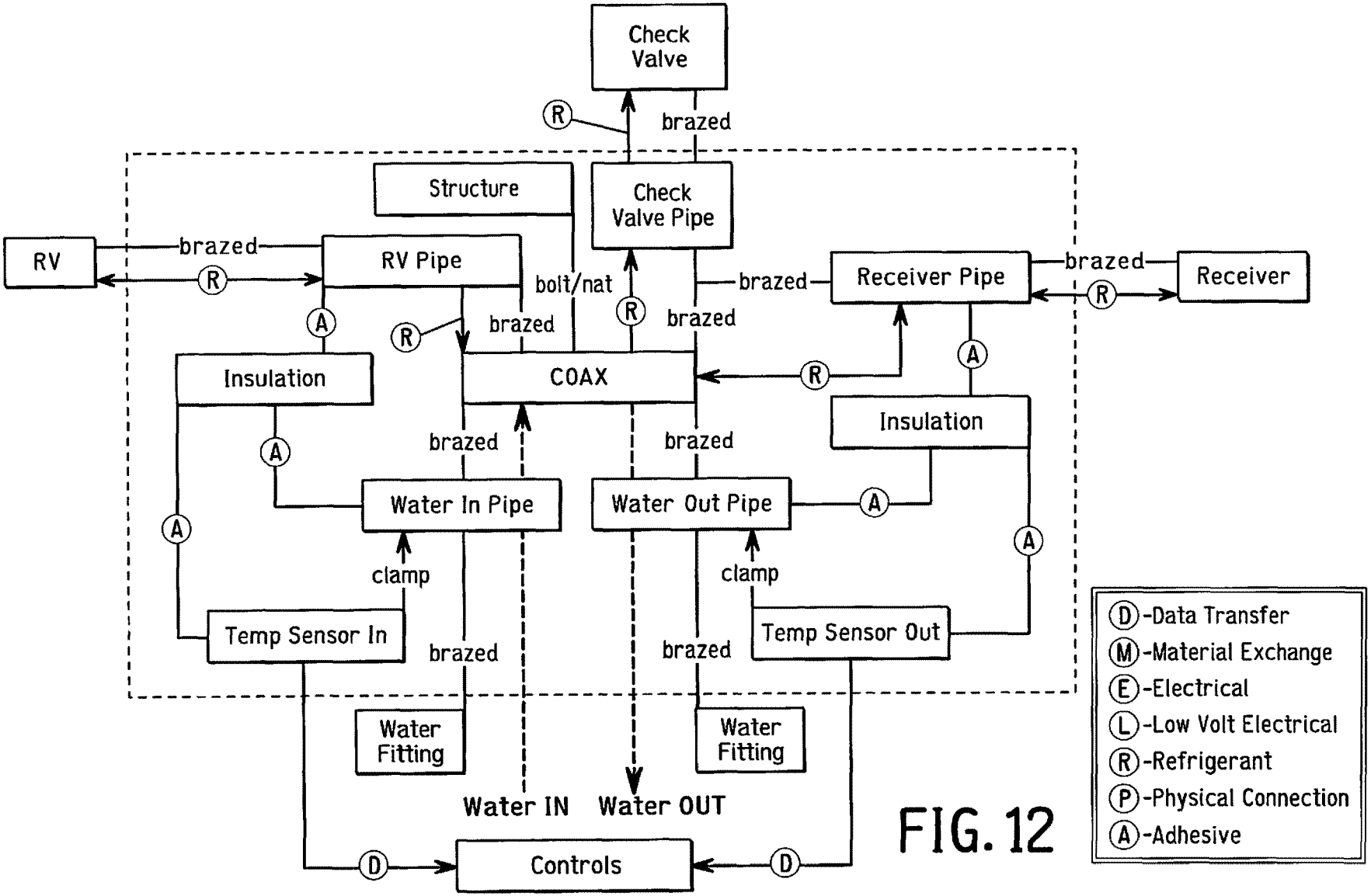
Figure 13:
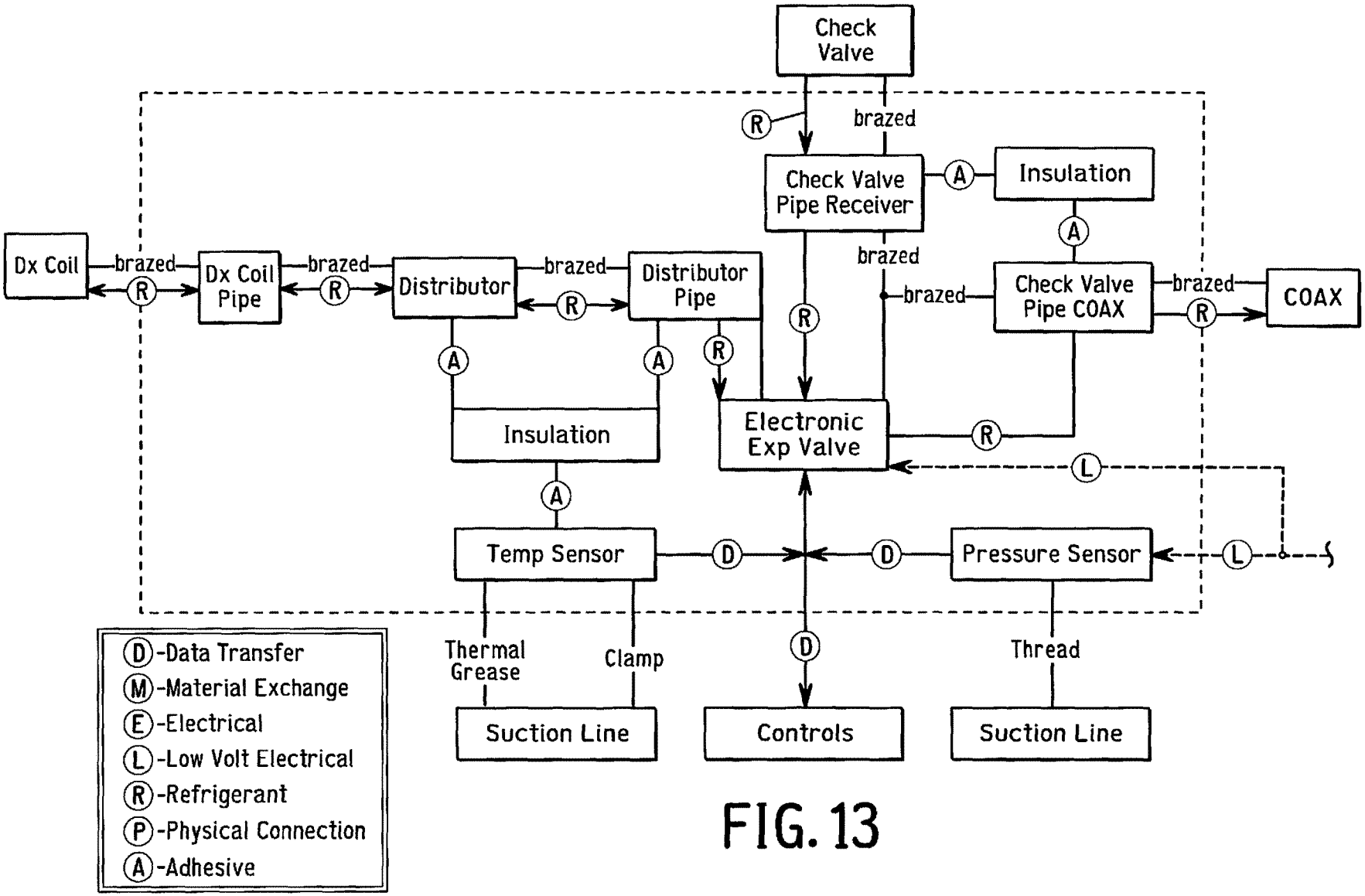
Figure 14:
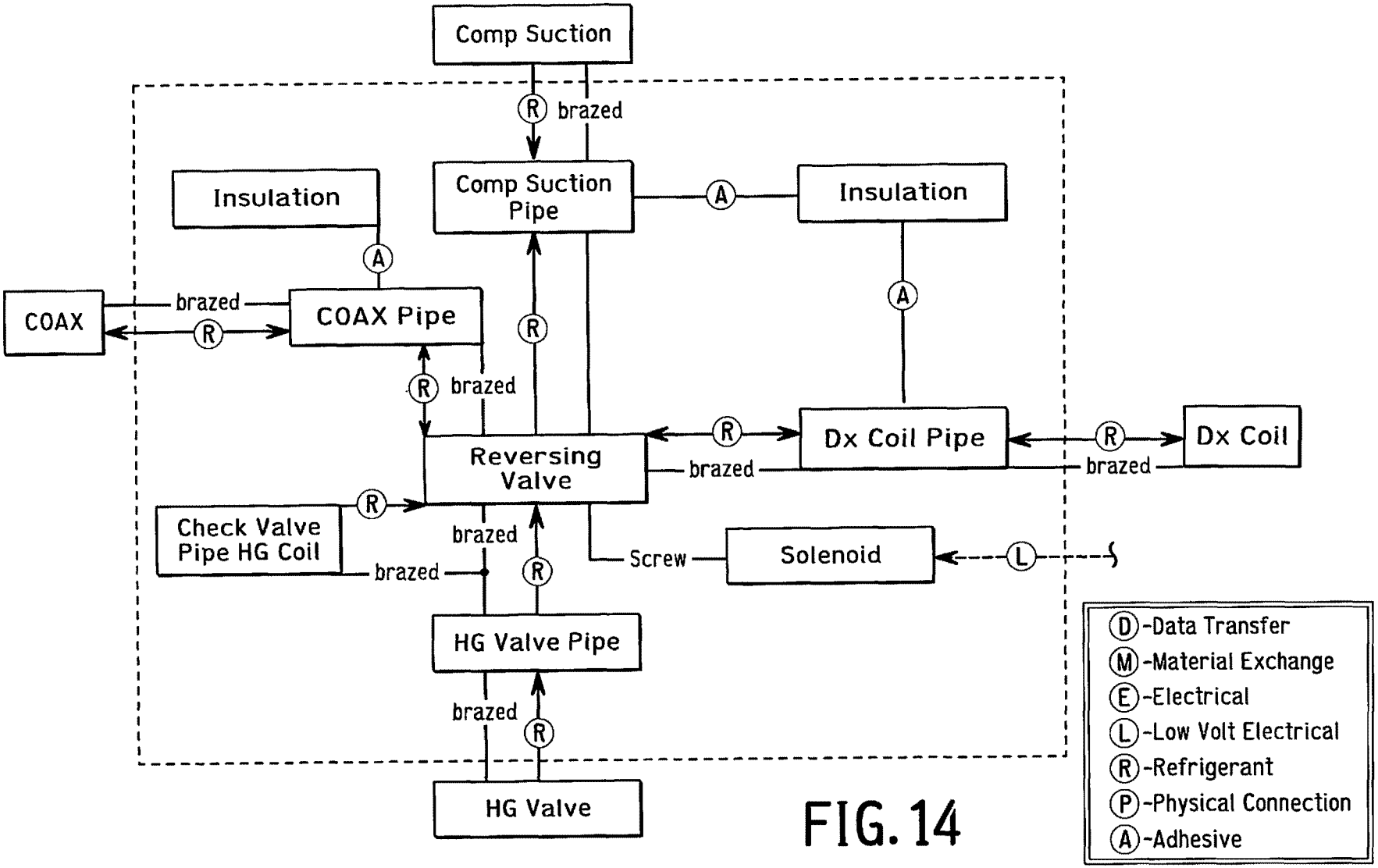
Figure 15:
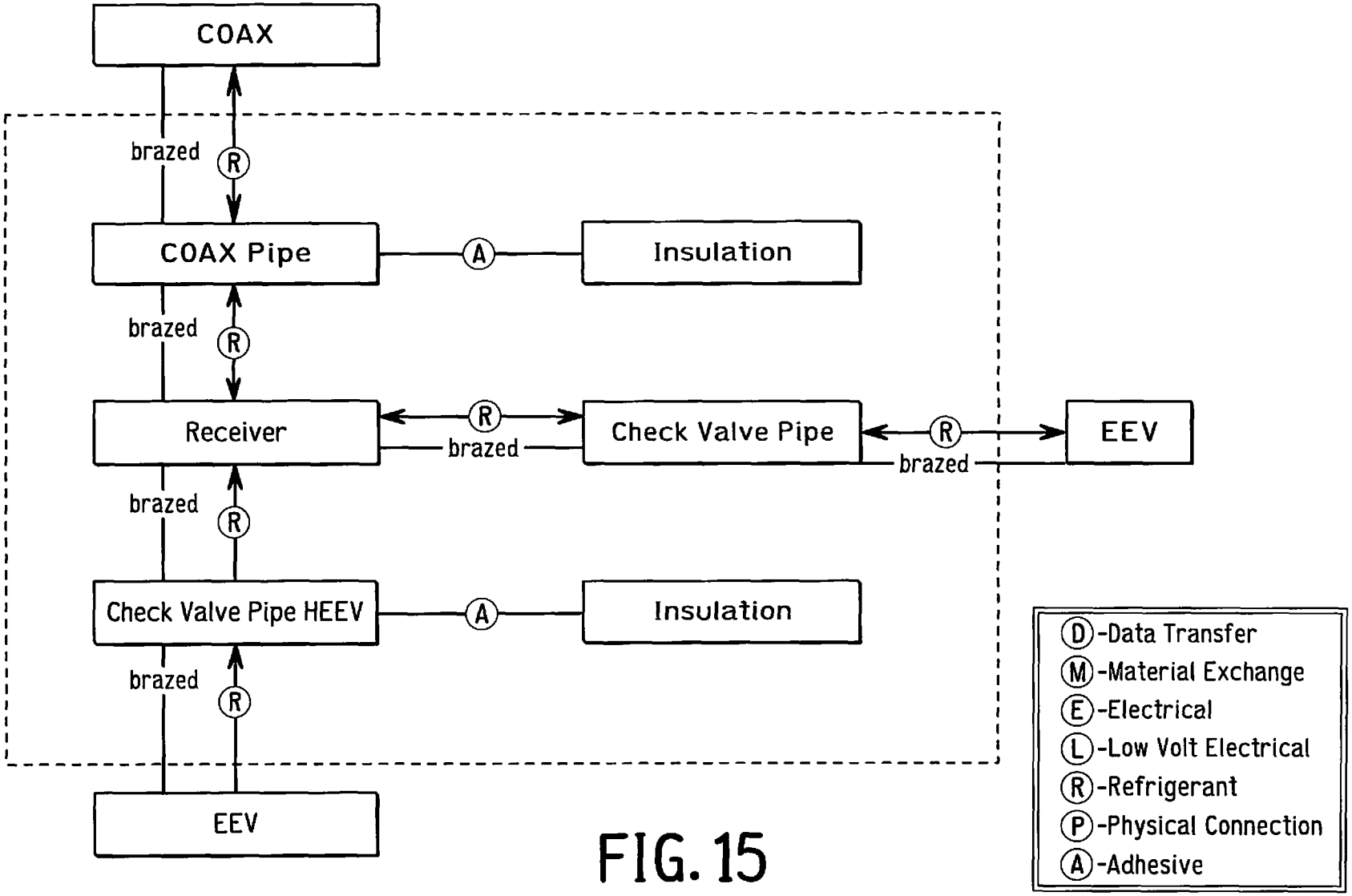
Figure 16:
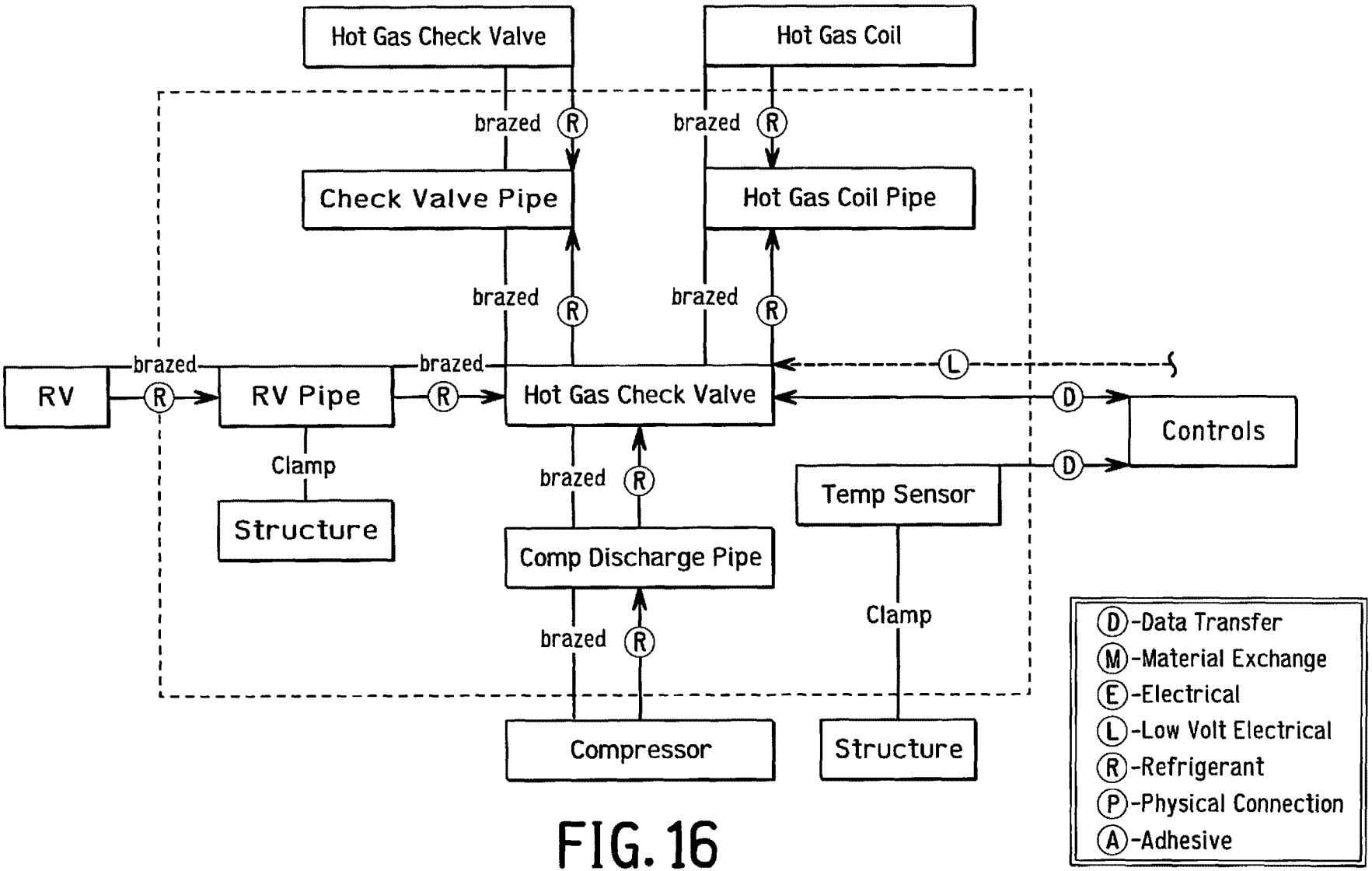
Figure 17:
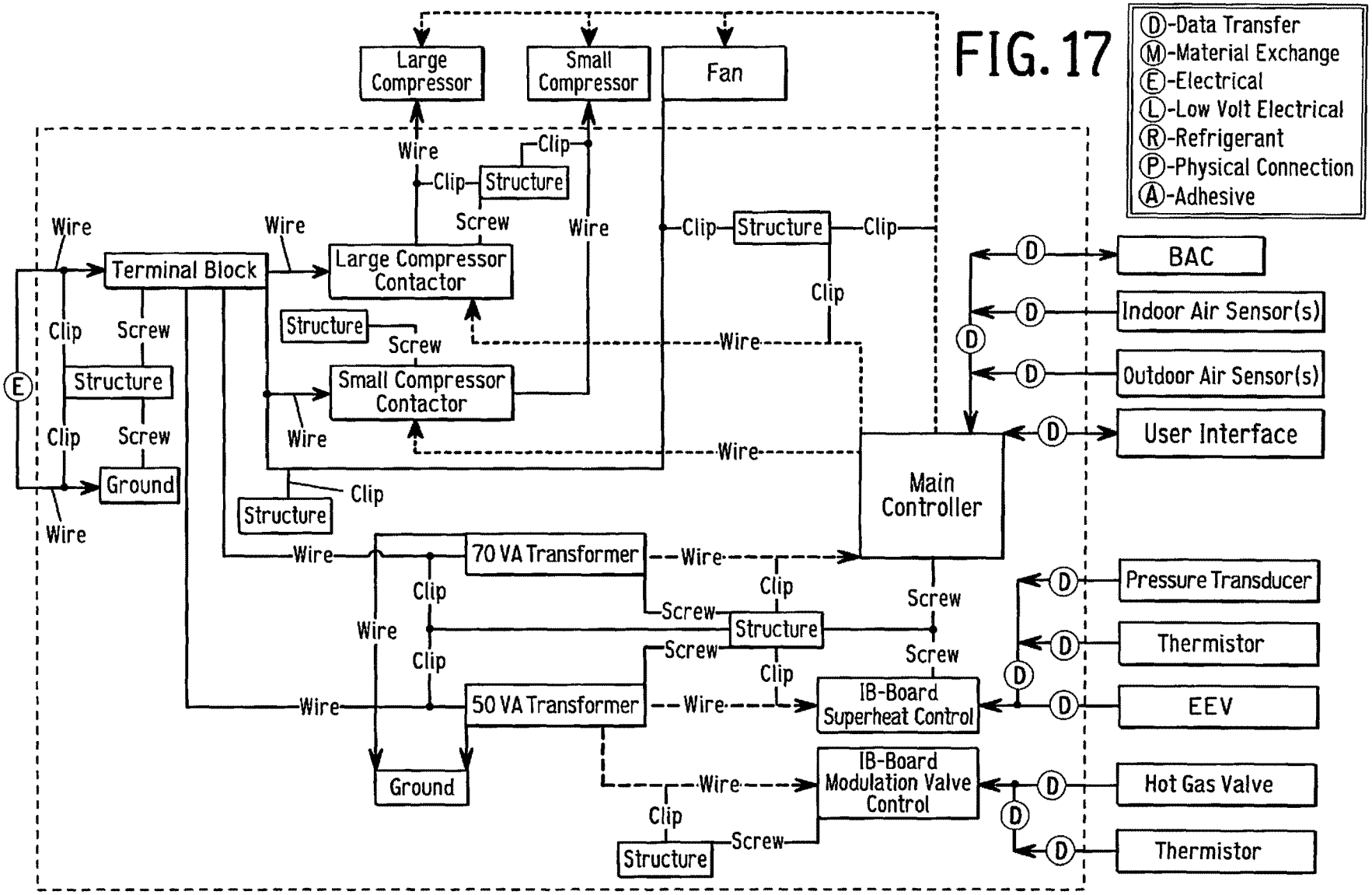
Figure 18:
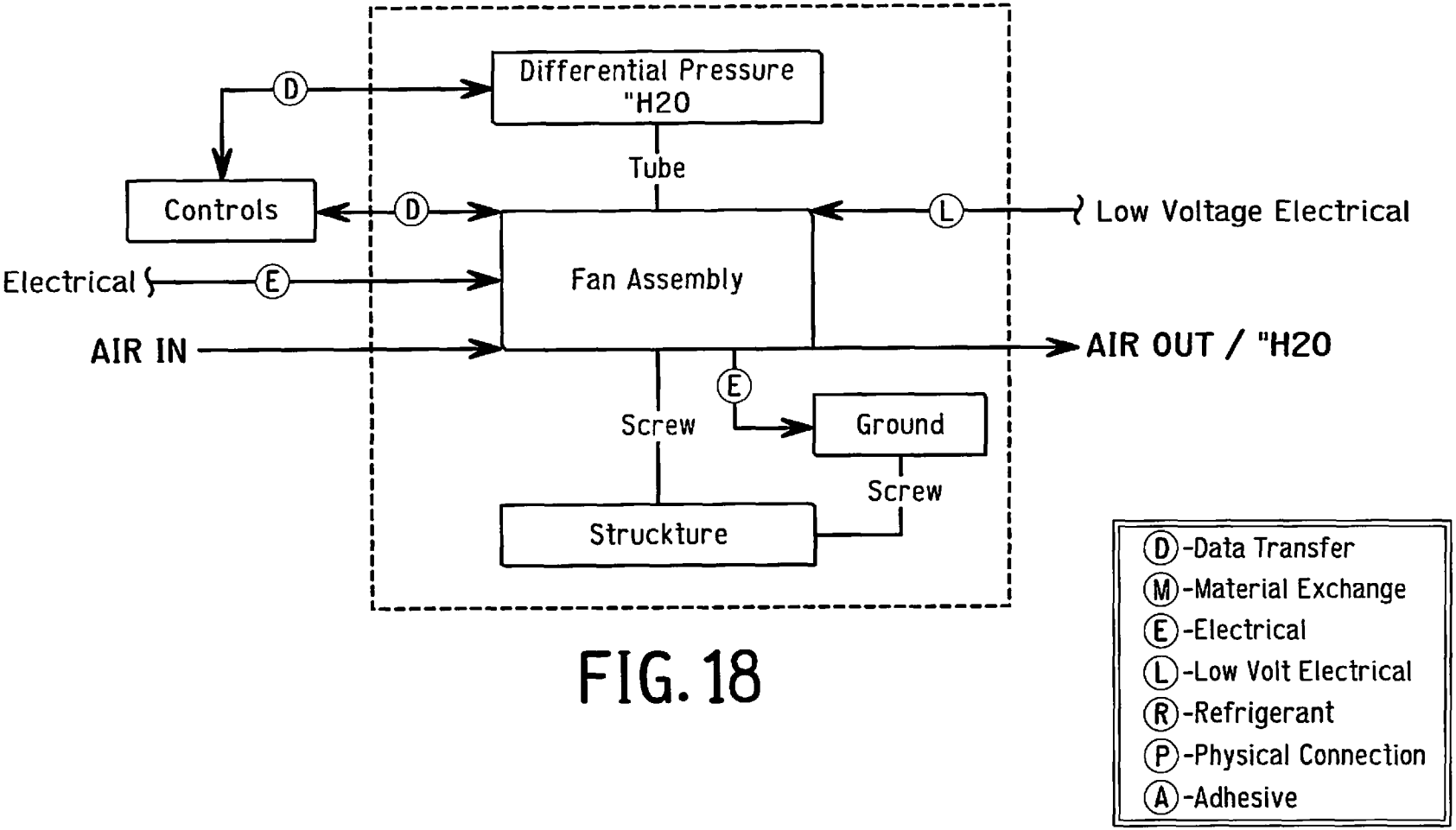
Figure 19:
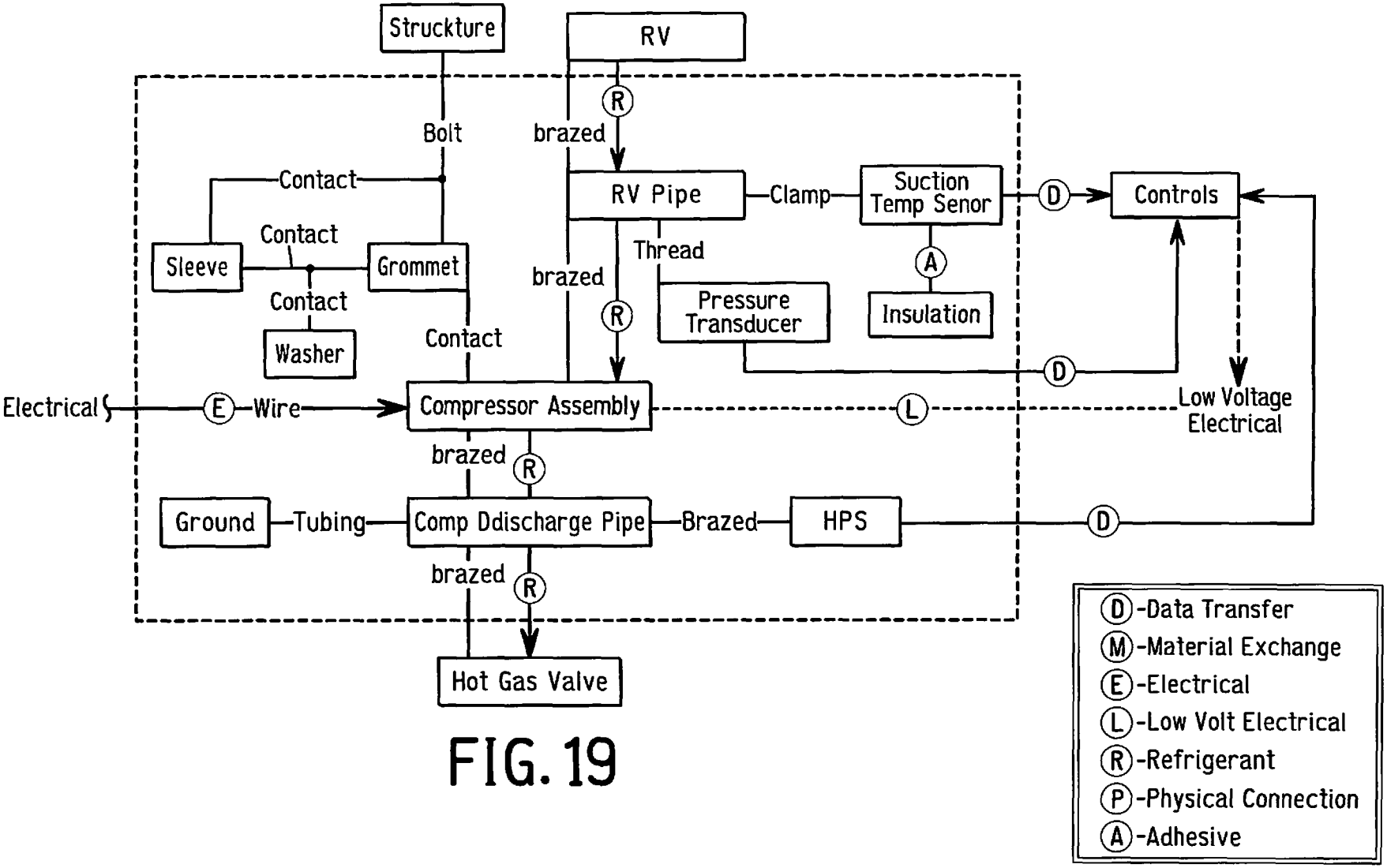
Figure 20:
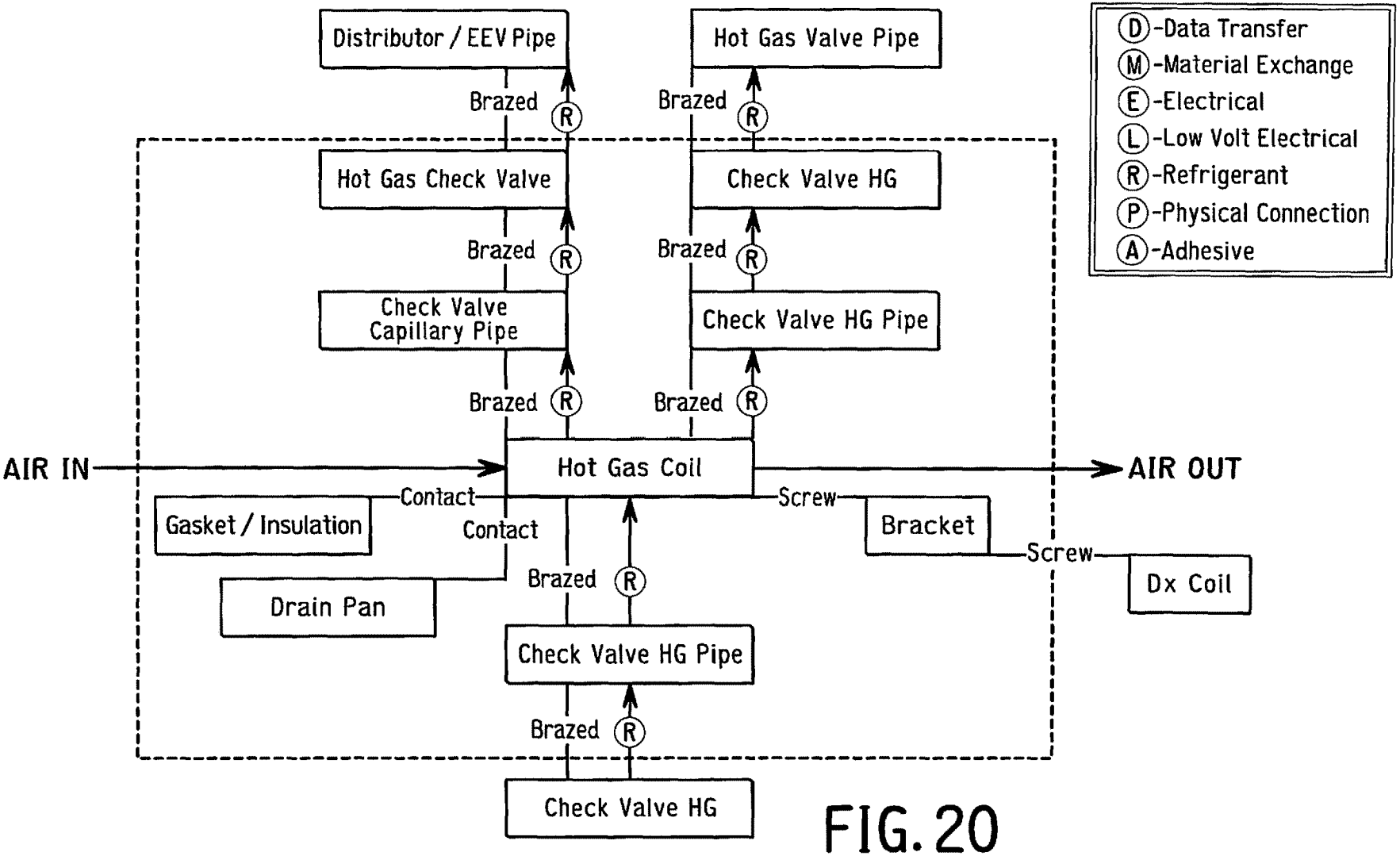
Figure 21:
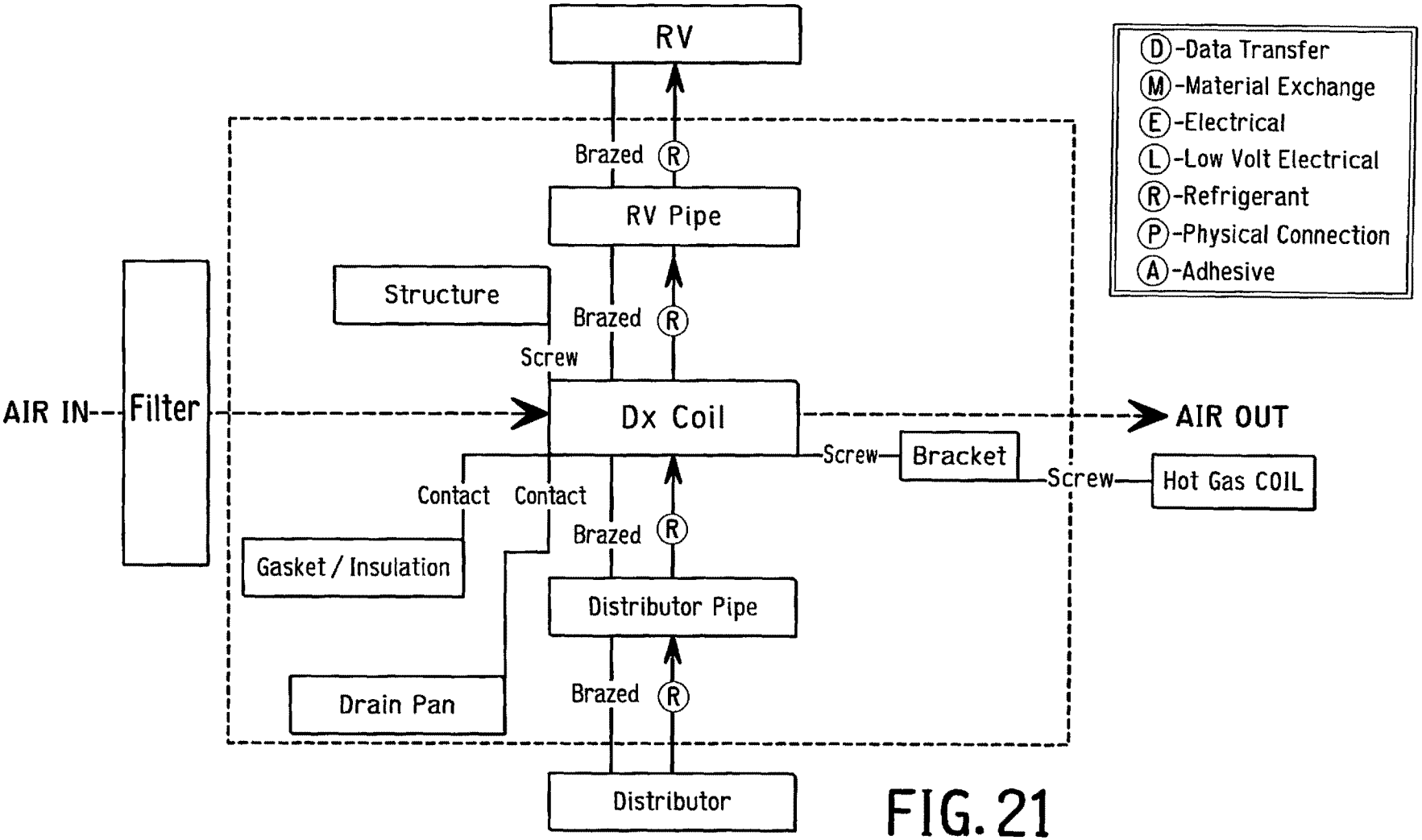

Fifth, a receiver (R) is disposed between the brazed plate heat exchanger (BPHE) and the EEV. The receiver (R) only stores liquid refrigerant when the reversing valve (12) is in a so-called cooling mode (FIGS. 5-7) not when the reversing valve (12) is in a so-called heating mode (FIGS. 8-10). A check valve arrangement facilitates the functionality of the receiver (R).

Sixth, a suction pressure transducer and a suction temperature sensor are disposed between an inlet of the compressor (C') and the reversing valve (12). The suction pressure transducer and a suction temperature sensor are used to determine saturated suction temperature using an algorithm embedded in the controller. The compressor (C') staging is then controlled (set to the appropriate one of the at least 8 stages) to maintain facilitating leaving air state point of 55° F. dew point temperature. More specifically, minimum and maximum parameters of saturated suction temperature for each stage are determined in order to maintain a 55° F. dew point temperature. In a first or lowest stage the minimum allowable parameter goes down to 100 psi (31.5° F. saturate vapor temperature), which assists in protecting the system against potential coil freeze.

Seventh, and finally, there are or can be additional conventional T valves, check valves, bleed valves etc. that may be necessary to create the heat pump system (1') shown in FIGS. 5-10. The function/operating of these parts are self-evident to those of ordinary skill in the art from FIGS. 5-10 and the flow shown therein, and thus, will not be discussed in further detail herein.

Figure 5:
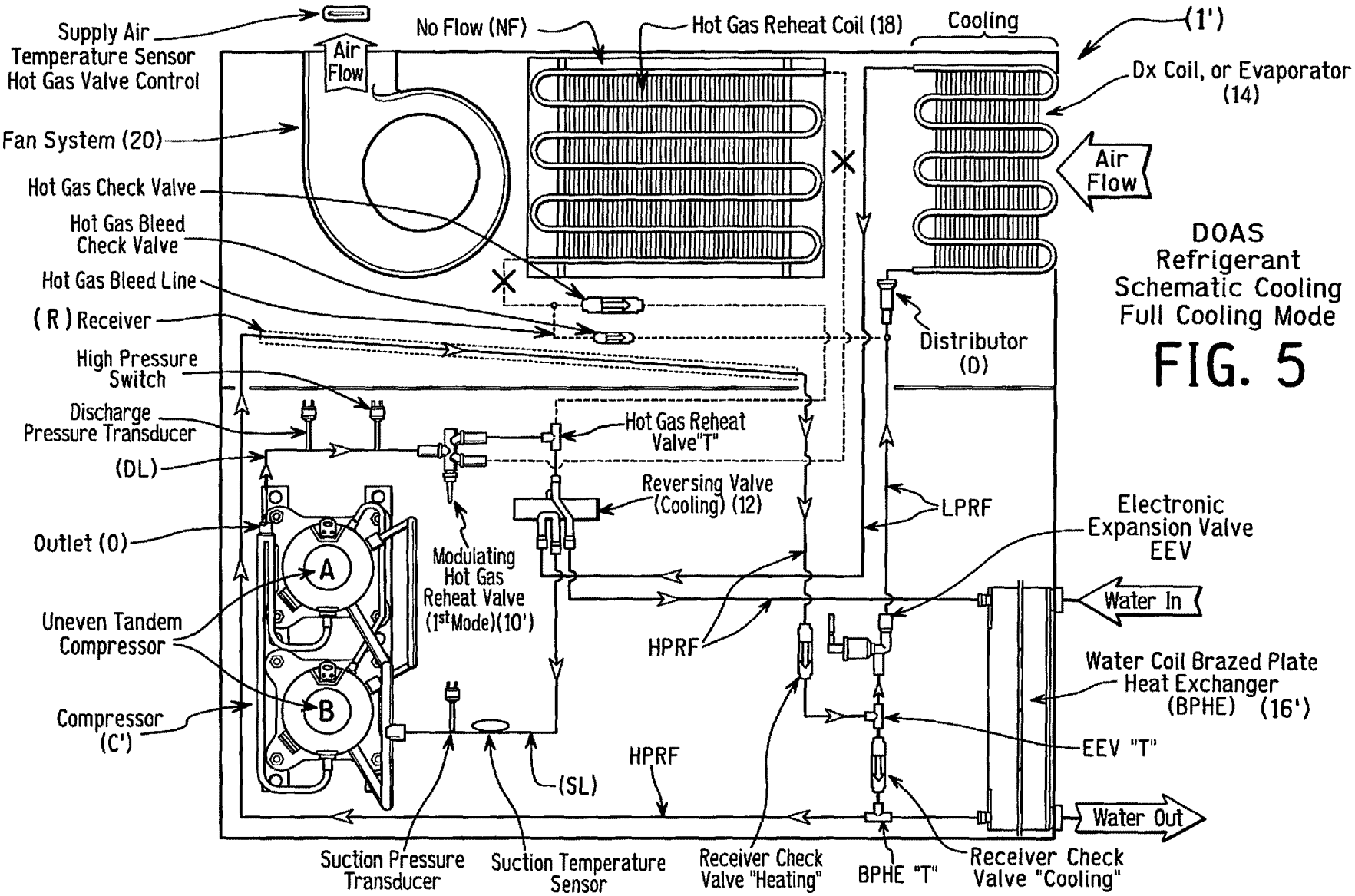
FIG. 5 illustrates an embodiment of a water source refrigerant heat pump schematic, which is a modification of the schematic of FIGS. 1-4, in a full cooling mode and with system parts identified for convenience like FIG. 4, including parts not present in FIG. 4.
Figure 6:
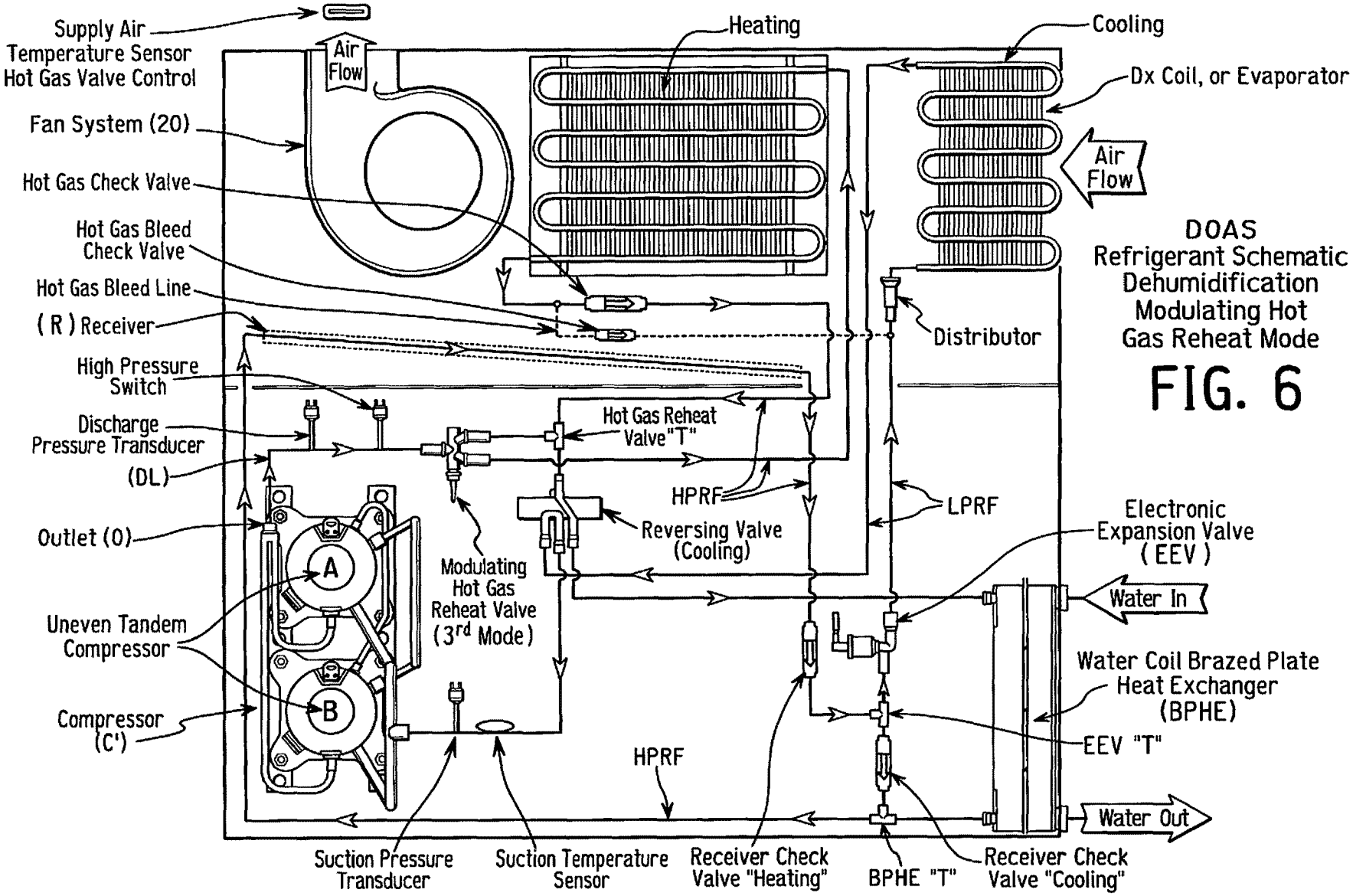
FIG. 6 is a schematic view of the heat pump illustrated in FIG. 5, in a modulating hot gas reheat mode.
Figure 7:
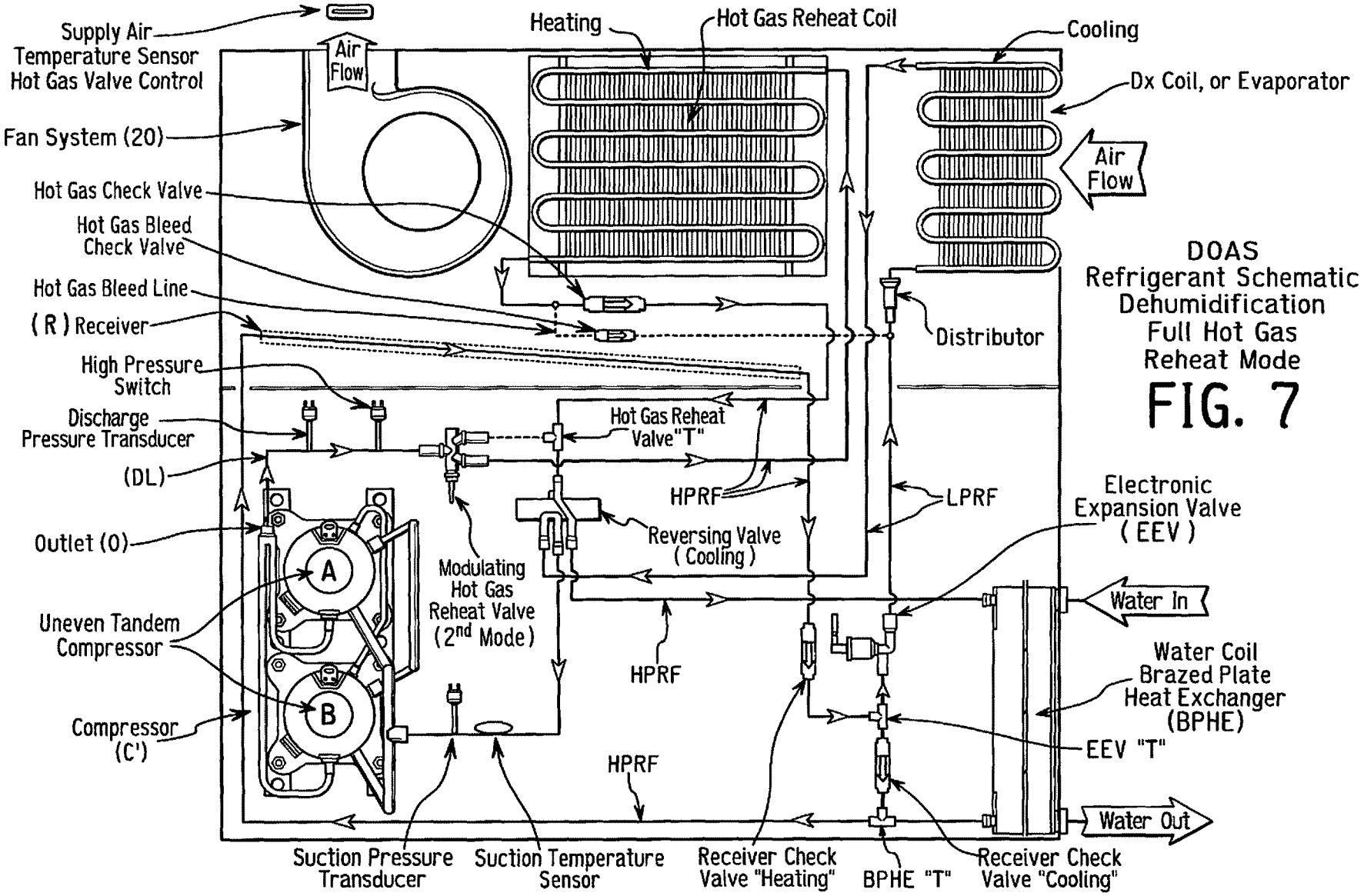
FIG. 7 is a schematic view of the heat pump illustrated in FIGS. 5-6, in a full hot gas reheat mode.

Referring initially to FIGS. 5-7, different operations of the heat pump system (1') when the reversing valve (12) is in a so-called cooling mode will now be explained. In these modes, the reversing valve (12) is in a same position in which the Dx coiling (14) performs cooling, and thus, the position of the reversing valve (12) can be considered a cooling position or mode. However, even if the reversing valve (12) is in the cooling mode, the compressor (C') and the modulating 3 way valve (10') (hot gas reheat valve) can be controlled to provide different levels of cooling and dehumidification.

In FIG. 5, a full cooling mode is illustrated. In the full cooling mode, the modulating 3 way valve (10') (hot gas reheat valve) is in a first position or mode in which the hot gas reheat coil (18) is not performing any function because there is no flow therethrough. Rather, all refrigerant discharged from the compressor (C') is sent to the brazed plate heat exchanger (BPHE) via the modulating three way valve (10'). In this mode, the compressor (C') and/or the EEV can be controlled to provide the desired amount of cooling of air provided to the target space.

In FIG. 6, a modulating hot gas reheat mode is illustrated. In the modulating hot gas reheat mode, the modulating 3 way valve (10') (hot gas reheat valve) is in a third position or mode in which the hot gas reheat coil (18) receives some refrigerant and the brazed plate heat exchanger receives some refrigerant from the compressor (C'). The refrigerant that is received by the hot gas reheat coil (18) joins the refrigerant to be supplied to the brazed plate heat exchanger after flowing through the hot gas reheat coil (18). The modulating 3 way valve (10') can modulate the amount of refrigerant supplied from both of the outlets thereof to modulate the amount of dehumidification (hot gas reheat). In addition, the temperature of air supplied to the target space can be finely adjusted in this mode. In this mode, the compressor (C') and/or the EEV can also be controlled to provide the desired amount of cooling, which can also be used to finely adjust the temperature of air supplied to the target space.

In FIG. 7, a full hot gas reheat mode is illustrated. In the full hot gas reheat mode, the modulating 3 way valve (10') (hot gas reheat valve) is in a second position or mode in which the hot gas reheat coil (18) receives all refrigerant from the compressor (C'), and the brazed plate heat exchanger only receives refrigerant that has already passed through the hot gas reheat coil (18). In this mode, maximum dehumidification can be provided. However, more air warming may also be provided by the hot gas reheat coil (18). Thus, the compressor (C') and/or the EEV can also be controlled to provide the desired amount of cooling, which can also be used to finely adjust the temperature of air supplied to the target space.

It should be noted that in FIGS. 5-7, the receiver (R) receives and delivers refrigerant. Therefore, even if the compressor is operated at a lower capacity sufficient refrigerant for sufficient cooling can be provided to the EEV and then the Dx coil (14).

Referring now to FIGS. 8-10, different operations of the heat pump system (1') when the reversing valve (12) is in a so-called heating mode will now be explained. In these modes, the reversing valve (12) is in a same position in which the Dx coiling performs heating, and thus, the position of the reversing valve (12) can be considered a heating position or mode. However, even if the reversing valve (12)

is in the heating mode, the compressor (C') and the modulating 3 way valve (10') (hot gas reheat valve) can be controlled to provide different levels of heating.

In FIG. 8, a dual condensing full heating mode is illustrated. In the dual condensing full heating mode, the modulating 3 way valve (10') (hot gas reheat valve) is in a second position or mode in which the hot gas reheat coil (18) receives all refrigerant from the compressor (C'), and then the Dx coil (14) receives the refrigerant that has already passed through the hot gas reheat coil (18). The refrigerant exiting the Dx coil (14), then flows to the EEV before being supplied to the brazed plate heat exchanger (BPHE). In this mode, maximum heating can be provided. Specifically, the compressor (C') and/or the EEV can also be controlled to provide the desired amount of heating, which can also be used to adjust the temperature of air supplied to the target space. In this mode, 0 degree air can be heated to at least 65 degrees without the need for preheat. Preheat can be considered heating of the air by a device other than a heat exchanger containing refrigerant of the heat pump system (1'). For example an electric heater or gas furnace would be considered a preheater. The multi stage compressor (C') assists with capability. In the past, it has not been possible to heat 0 degree air to 65 degrees or more without a preheater. Degrees referred to herein are Fahrenheit.

In FIG. 9, a dual condensing modulating heating mode is illustrated. In the dual condensing modulating heating mode, the modulating 3 way valve (10') (hot gas reheat valve) is in a third position or mode in which the hot gas reheat coil (18) receives some refrigerant and the Dx Coil (14) receives some refrigerant from the compressor (C'). The refrigerant that is received by the hot gas reheat coil (18) joins the refrigerant to be supplied to the Dx coil (14) after flowing through the hot gas reheat coil (18). The modulating 3 way valve (10') can modulate the amount of refrigerant supplied from both of the outlets thereof to modulate the amount of hot gas reheat and heating by the Dx coil. In addition, the temperature of air supplied to the target space can be finely adjusted in this mode. In this mode, the compressor (C') and/or the EEV can also be controlled to provide the desired amount of heating, which can also be used to finely adjust the temperature of air supplied to the target space.

In FIG. 10, a dual condensing Dx coil only heating mode is illustrated. In the dual condensing Dx coil only heating mode, the modulating 3 way valve (10') (hot gas reheat valve) is in a first position or mode in which the hot gas reheat coil (18) is not performing any function because there is no flow therethrough. Rather, all refrigerant discharged from the compressor (C') is sent to the Dx coil (14) via the modulating three way valve (10'). In this mode, the compressor (C') and/or the EEV can be controlled to provide the desired amount of heating of air provided to the target space.

It should be noted that in FIGS. 8-10, the receiver (R) does not receive and deliver refrigerant.

FIGS. 11-21 illustrate operations and/or connections of various parts including electrical, low voltage, data transfer, material exchange (water or liquid), refrigerant, physical connections such as brazing, and adhesive. Those of ordinary skill in the art are familiar with such schematics in order to connect/operate the heat pump (1') in accordance with the present invention.

As can be understood from the above the heat pump system (1') in accordance with the present invention includes a compressor, a usage side heat exchanger, a heat source side heat exchanger, an expansion mechanism, a main refrigerant flow control device, a gas reheat heat exchanger, a fan (20), and a secondary refrigerant flow control device.

The compressor delivers compressed refrigerant to a discharge line (DL) and receives a refrigerant from a suction line (SL). Examples of compressors include scroll, piston/cylinder, screw, and centrifugal compressor. The compressor of the illustrated embodiment is not limited to a particular type. However, as explained above, the compressor (C') preferably has two different sized compressors, each having two stages. The usage side heat exchanger is an air/refrigerant heat exchanger, which is identified as a Dx coil or Evaporator (14) in the drawings. One example is a fin and tube heat exchanger. However, the usage side heat exchanger of the illustrated embodiment is not limited to a particular type. The heat source side heat exchanger in the illustrated embodiment is a liquid/refrigerant heat exchanger, more specifically a water/refrigerant heat exchanger, even more specifically a brazed plate heat exchanger arranged to exchange heat between a heat transfer medium (water) and refrigerant flowing therethrough. However, the heat source side heat exchanger of the illustrated embodiment is not limited to a particular type. The expansion mechanism in the illustrated embodiment is an EEV. However, other examples of expansion mechanisms include thermal expansion valves (TEV), and orifices. However, the expansion mechanism is not intended to be limited to any particular type. The main refrigerant flow control device is switchable between a cooling mode in which refrigerant flows from the discharge line (DL) through part of a refrigerant circuit, to the heat source side heat exchanger, to the expansion mechanism and then to the usage side heat exchanger, and a heating mode in which refrigerant flows from the discharge line (DL) through part of the refrigerant circuit to the usage side heat exchanger, to the expansion device and then to the heat source side heat exchanger. The main refrigerant flow control device of the illustrated embodiment is a 4-way reversing valve (12). Other examples include multiple one, two and/or three way valves. However, the main refrigerant flow control device is not intended to be limited to any particular type. The gas reheat heat exchanger connected in the refrigerant circuit is an air/refrigerant heat exchanger. One example is a fin and tube heat exchanger. However, the gas reheat heat exchanger of the illustrated embodiment is not limited to a particular type. The fan (20), identified in the drawings as "fan system" is disposed to direct an airflow across the usage side heat exchanger and the gas reheat heat exchanger into a target space. Examples of suitable fans include, an axial flow fan, a cross-flow fan and a centrifugal fan. However, the fan (20) of the illustrated embodiment is not limited to a particular type. The secondary refrigerant flow control device is switchable between a first mode in which refrigerant flows from the discharge line (DL) to the main refrigerant flow control device, a second mode in which refrigerant flows from the discharge line (DL) to the gas reheat heat exchanger and then flows to the main refrigerant flow control device, and a third mode in which refrigerant flows both from the discharge line (DL) to the gas reheat heat exchanger and then flows to the main refrigerant flow control device, and from the discharge line (DL) to the main refrigerant flow control device without flowing through the gas reheat heat exchanger. The secondary refrigerant flow control device in the illustrated embodiment is a modulating three-way valve (10'). However, the secondary refrigerant flow control device is not intended to be limited to any particular type. The refrigerant circuit and the main and secondary refrigerant flow control devices are arranged and configured such that refrigerant may flow to the usage side heat exchanger and the hot gas reheat heat exchanger when the main refrigerant flow control device is in the heating mode.

The refrigerant circuit and the main and secondary refrigerant flow control devices are arranged and configured such that refrigerant may flow to the usage side heat exchanger and the hot gas reheat heat exchanger when the main refrigerant flow control device is in the cooling mode (FIGS. 6-7). The refrigerant circuit and the main and secondary refrigerant flow control devices are arranged and configured such that refrigerant may flow to the usage side heat exchanger and the hot gas reheat heat exchanger when the secondary refrigerant flow control device is in at least one of the second and third modes (FIGS. 6-7). More specifically, the refrigerant circuit and the main and secondary refrigerant flow control devices are arranged and configured such that refrigerant may flow to the usage side heat exchanger and the hot gas reheat heat exchanger when the secondary refrigerant flow control device is in both of the second and third modes (FIGS. 6-7), one of the second and third modes includes series flow through the hot gas reheat heat exchanger and the usage side heat exchanger (e.g., the second mode of FIG. 7), and the other of the second and third modes includes parallel flow through to the usage side heat exchanger and the hot gas reheat heat exchanger (e.g., the third mode of FIG. 6).

As mentioned above, the heat transfer medium of the heat source side heat exchanger is a liquid, e.g., water. In addition, the heat source side heat exchanger is a brazed plate heat exchanger. Also, in the illustrated embodiment, the secondary refrigerant flow control device is a modulating three way valve. Also, the compressor includes at least one of two stages and two compressors, preferably at least two compressors with each compressor including at least two stages. Thus, in the illustrated embodiment, the compressor is an uneven tandem compressor that is operable to provide at least 8 different output stage levels. The compressor output is controlled based on saturated suction temperature on a suction side of the compressor. The refrigerant circuit includes at least one of a suction pressure sensor and a suction temperature sensor utilized to determine the saturated suction temperature. In the illustrated embodiment, the refrigerant circuit includes a suction pressure sensor and a suction temperature sensor disposed on the suction side of the compressor, which are utilized to determine the saturated suction temperature.

As mentioned above, the refrigerant circuit further includes a receiver (R) disposed on an inlet side of the expansion mechanism when the main refrigerant flow control device is in the cooling mode. In the illustrated embodiment, refrigerant flows to the receiver (R) when the main refrigerant flow control device is in the cooling mode, and refrigerant does not flow to the receiver (R) when the main refrigerant flow control device is in the heating mode. In the illustrated embodiment, the receiver (R) is an inclined tube receiver (R), promotes phase separation, and ensures liquid seat is maintained at the EEV.

As mentioned above, in the heating mode the heat pump (1) is configured to heat 0 degree air to 65 degrees or more. More specifically, the heat pump (1) is configured to heat 0 degree air to 65 degrees or more when the main refrigerant flow control device is in a heating mode and the secondary refrigerant flow control device is in the second position, which can be considered 100% hot gas.

It will be apparent to those skilled in the art from this disclosure that an electronic controller can be used to control the compressor (C'), the EEV, and the modulating 3 way valve (10') based on signals received from the various sensors. Of course, separate electronic controllers for separate parts can also be used, e.g., the PID controller for the modulating three way valve, which should preferably communicate with each other via wires or wired communications. If an electronic controller is used (e.g., for the main controller) the electronic controller is conventional, and thus, includes at least one microprocessor or CPU, an Input/output (I/O) interface, Random Access Memory (RAM), Read Only Memory (ROM), a storage device (either temporary or permanent) forming a computer readable medium programmed to execute one or more control programs to control the heat pump. The heat pump controller may optionally include an input interface such as a keypad to receive inputs from a user and a display device used to display various parameters to a user. The parts and programming are conventional, except as related to controlling surge, and thus, will not be discussed in detail herein, except as needed to understand the embodiment(s).

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A heat pump system comprising:

a compressor, the compressor delivering compressed refrigerant to a discharge line and receiving a refrigerant from a suction line;

a usage side heat exchanger;

a heat source side heat exchanger arranged to exchange heat between a heat transfer medium and refrigerant flowing therethrough;

an expansion valve;

a main refrigerant flow control valve switchable between a cooling mode in which refrigerant is configured to flow from the discharge line through part of a refrigerant circuit, to the heat source side heat exchanger, to the expansion valve and then to the usage side heat exchanger, and a heating mode in which refrigerant is configured to flow from the discharge line through part of the refrigerant circuit to the usage side heat exchanger, to the expansion valve and then to the heat source side heat exchanger;

a hot gas reheat heat exchanger connected in the refrigerant circuit;

a fan disposed to direct an airflow across the usage side heat exchanger and the hot gas reheat heat exchanger into a target space;

a receiver connected in the refrigerant circuit between the heat source side heat exchanger and the expansion valve in a flow direction of the refrigerant, the receiver being configured such that refrigerant flows through the receiver to an inlet side of the expansion valve when the main refrigerant flow control valve is in the cooling mode, and configured such that refrigerant does not flow to the receiver when the main refrigerant control valve is in the heating mode; and a secondary refrigerant flow control valve switchable between a first mode in which refrigerant is configured to flow from the discharge line to the main refrigerant flow control valve, a second mode in which refrigerant is configured to flow from the discharge line to the hot gas reheat heat exchanger and then flows to the main refrigerant flow control valve, and a third mode in which refrigerant is configured to flow both from the discharge line to the hot gas reheat heat exchanger and then flows to the main refrigerant flow control valve, and from the discharge line to the main refrigerant flow control valve without flowing through the hot gas reheat heat exchanger, the refrigerant circuit and the main and secondary refrigerant flow control valves being configured such that refrigerant flows to the usage side heat exchanger and the hot gas reheat heat exchanger when the main refrigerant flow control valve is in the heating mode, and the refrigerant circuit and the main and secondary refrigerant flow control valves are configured such that the refrigerant flows to the hot gas reheat heat exchanger before flowing to the heat source side heat exchanger when the main refrigerant flow control valve is in the cooling mode.

2. The heat pump according to claim 1, wherein the refrigerant circuit and the main and secondary refrigerant flow control valves are configured such that refrigerant flows to the usage side heat exchanger and the hot gas reheat heat exchanger when the main refrigerant flow control valve is in the cooling mode.

3. The heat pump according to claim 1, wherein the refrigerant circuit and the main and secondary refrigerant flow control valves are configured such that refrigerant flows to the usage side heat exchanger and the hot gas reheat heat exchanger when the secondary refrigerant flow control valve is in at least one of the second and third modes.

4. The heat pump according to claim 3, wherein the refrigerant circuit and the main and secondary refrigerant flow control valves are configured such that refrigerant flows to the usage side heat exchanger and the hot gas reheat heat exchanger when the secondary refrigerant flow control valve is in both of the second and third modes, one of the second and third modes including series flow through the hot gas reheat heat exchanger and the usage side heat exchanger, and the other of the second and third modes including parallel flow through to the usage side heat exchanger and the hot gas reheat heat exchanger.

5. The heat pump according to claim 1, wherein the heat transfer medium of the heat source side heat exchanger is a liquid.

6. The heat pump according to claim 5, wherein the heat transfer medium of the heat source side heat exchanger is water.

7. The heat pump according to claim 5, wherein the heat source side heat exchanger is a brazed plate heat exchanger.

8. The heat pump according to claim 1, wherein the secondary refrigerant flow control valve is a modulating three way valve.

9. The heat pump according to claim 1, wherein the compressor includes at least one of two stages and two compressors.

10. The heat pump according to claim 9, wherein the compressor includes at least two compressors with each compressor including at least two stages.

11. The heat pump according to claim 10, wherein the compressor is an uneven tandem compressor configured to provide at least 8 different output stage levels.

12. The heat pump according to claim 9, wherein the compressor output is controlled by an electronic controller based on saturated suction temperature on a suction side of the compressor.

13. The heat pump according to claim 12, wherein the refrigerant circuit includes at least one of a suction pressure sensor and a suction temperature sensor utilized to determine the saturated suction temperature.

14. The heat pump according to claim 13, wherein the refrigerant circuit includes a suction pressure sensor and a suction temperature sensor disposed on the suction side of the compressor, which are utilized to determine the saturated suction temperature.

15. The heat pump according to claim 1, wherein the refrigerant flows to the receiver when the main refrigerant flow control valve is in the cooling mode.

16. The heat pump according to claim 1, wherein the receiver is an inclined tube receiver configured to promote phase separation and to ensure liquid seat is maintained at the expansion valve.

17. The heat pump according to claim 1, wherein the main refrigerant flow control valve is a four-way valve.

18. The heat pump according to claim 1, wherein in the heating mode the heat pump is configured to heat 0 degree air to 65 degrees or more.

19. The heat pump according to any of claim 18, wherein the heat pump is configured to heat 0 degree air to 65 degrees or more when the main refrigerant flow control valve is in a heating mode and the secondary refrigerant flow control valve is in the second position.

* * * * *